US010946687B2

(12) United States Patent
Maffeo et al.

(10) Patent No.: US 10,946,687 B2
(45) Date of Patent: Mar. 16, 2021

(54) SEWING OF BOOK BLOCKS WITHOUT BLIND STITCH

(71) Applicant: Meccanotecnica S.p.A., Gazzaniga (IT)

(72) Inventors: Rossano Maffeo, Ranica (IT); Fernando Brignoli, Torre de'Roveri (IT); Paolo Martini, Torre Boldone (IT)

(73) Assignee: Meccanotecnica S.p.A., Gazziniga (IT)

( * ) Notice: Subject to any disclaimer, the term of this patent is extended or adjusted under 35 U.S.C. 154(b) by 173 days.

(21) Appl. No.: 16/307,707

(22) PCT Filed: Jul. 20, 2017

(86) PCT No.: PCT/IB2017/054395
§ 371 (c)(1),
(2) Date: Dec. 6, 2018

(87) PCT Pub. No.: WO2018/015916
PCT Pub. Date: Jan. 25, 2018

(65) Prior Publication Data

US 2019/0255871 A1 Aug. 22, 2019

(30) Foreign Application Priority Data

Jul. 21, 2016 (IT) ..... 102016000076757

(51) Int. Cl.
*B42B 2/08* (2006.01)
*B42B 2/02* (2006.01)
*B42B 2/04* (2006.01)

(52) U.S. Cl.
CPC ..... *B42B 2/08* (2013.01); *B42B 2/02* (2013.01); *B42B 2/04* (2013.01)

(58) Field of Classification Search
CPC ..... B42B 2/08; B42B 2/02; B42B 2/04
See application file for complete search history.

(56) References Cited

U.S. PATENT DOCUMENTS 5,248,234 A * 9/1993 Hollenstein ..... B42B 2/00 112/21
5,507,524 A * 4/1996 Botschi ..... B42B 2/04 281/27
5,984,603 A * 11/1999 Boetschi ..... B42B 2/00 412/35

FOREIGN PATENT DOCUMENTS

CN 102926137 A 2/2013
EP 0295220 A1 12/1988
(Continued)

OTHER PUBLICATIONS

International Searching Authority, "International Search Report and Written Opinion from PCT Application No. PCT/IB2017/054395 dated Dec. 22, 2017" pp. 1-13; Published in WO.
(Continued)

*Primary Examiner* — Patrick H Mackey
(74) *Attorney, Agent, or Firm* — Fogg & Powers LLC

(57) ABSTRACT

A solution is proposed for sewing blocks of signatures in a bookbinding sewing machine. A corresponding method comprises, for each block of signatures, bringing a portion of each sewing thread through a corresponding free loop (by moving obliquely and then along an advancement direction of the blocks of signatures), blocking, cutting and pulling the sewing thread for tightening the free loop around the sewing thread being cut. A further aspect provides a corresponding sewing station. A further aspect provides a bookbinding sewing machine comprising this sewing station.

27 Claims, 15 Drawing Sheets

(56) References Cited

FOREIGN PATENT DOCUMENTS

| | | | | | |
|---|---|---|---|---|---|
| EP | 0603126 | A1 | | 6/1994 | |
| EP | 1477322 | A1 | * | 11/2004 | ..... B42B 2/02 |
| EP | 1477322 | A1 | | 11/2004 | |
| EP | 1518714 | A1 | * | 3/2005 | ..... B42B 2/02 |
| EP | 1518714 | A1 | | 3/2005 | |
| GB | 362820 | A | | 12/1931 | |

OTHER PUBLICATIONS

China Patent Office, "Office Action from CN Application No. 201780036855.1", dated Mar. 10, 2020, pp. 1 through 6, Published: CN.

* cited by examiner

SEWING OF BOOK BLOCKS WITHOUT BLIND STITCH

This application claims priority to International Patent Application No. PCT/IB2017/054395 filed on Jul. 20, 2017, which claims priority to IT Patent Application No. 102016000076757 filed on Jul. 21, 2016.

TECHNICAL FIELD

The present disclosure relates to the bookbinding field. More specifically, this disclosure relates to the sewing of blocks of signatures.

TECHNOLOGICAL CONTEXT

The background of the present disclosure is hereinafter introduced with the discussion of techniques relating to its context. However, even when this discussion refers to documents, acts, artifacts and the like, it does not suggest or represent that the discussed techniques are part of the prior art or are common general knowledge in the field relevant to the present disclosure.

Signatures are commonly sewn together at blocks (in bookbinding sewing machines), so as to obtain book blocks for the production of corresponding books (of sewn type); for this purpose, stitchings are formed by means of corresponding (sewing) thread between the signatures of each block, by using one or more needles and crochets; particularly, the stitchings comprise rows of plain stitches (formed by the needles) and rows of looped stitches (formed by the crochets) concatenated to each other. Once a last signature of the block has been sewn, the threads are cut so as to separate the corresponding book block. Therefore, on the last signature each row of plain stitches ends with a free tail and each row of looped stitches ends with a free loop.

However, the cut threads (i.e., the free tails and/or the free loops) may return into the last signature. When this happens, the corresponding stitchings loosen thereby compromising the compactness and integrity of the book block during its next processing steps (with the last signature that may easily slide with respect to the rest of the book block up to detach). Therefore, a blind stitch, i.e., without any signature, is typically made after sewing the last signature; in this way, in each stitching the free tail is blocked into the free loop so as to prevent the thread from returning into the last signature. However, the making of the blind stitches reduces the performance of the (bookbinding) sewing machines, since it requires an idle cycle (i.e., wherein no signature is sewn) at the end of each book block. This is particularly evident in the production of small books (for example, books for children), wherein each book block is formed by a reduced number of signatures, since the ratio between the idle cycles and the operating cycles being actually useful (wherein the signatures are sewn) is very high (for example, 25-33% for blocks formed by 4-3 signatures, respectively).

Several techniques have been proposed over time for avoiding making the blind stitches.

For example, IT-A-MI2003A001921 proposes applying glue between the last two signatures of each book block (on a scrap portion thereof).

IT-B-0001248875 instead proposes using threads impregnated with glue.

However, the use of glue may get various members of the sewing machine dirty and it may hinder the complete opening of the books.

U.S. Pat. No. 5,507,524 proposes anchoring every free loop to the book block or to the rest of the corresponding stitching (for example, by fusing the corresponding thread for welding it to the book block or to the rest of the stitching).

However, this requires the use of special threads (with a high content of synthetic fibers), with a negative impact on the operating costs of the sewing machines (and therefore of the books produced by them).

EP-A-1477322 proposes making a blind stitch over the last signature while a movable saddle (used for feeding the signatures to be sewn in succession) opens to receive a first signature of a next block; for this purpose, for each thread the crochet rotates the free loop by 90° and an auxiliary crochet hooks the thread close to the needle and pulls it within the (rotated) free loop, after which the thread is cut.

IT-B-0001382877 proposes exploiting a transverse enlargement of each thread outside the last signature (for example, by forming a knot or by using a pre-knotted thread) to prevent a return of the thread into the last signature.

However, such techniques are not completely effective; particularly, the stitching may loosen in any case (thereby compromising the compactness and integrity of the book block).

SUMMARY

A simplified summary of the present disclosure is herein presented in order to provide a basic understanding thereof; however, the sole purpose of this summary is to introduce some concepts of the disclosure in a simplified form as a prelude to its following more detailed description, and it is not to be interpreted as an identification of its key elements nor as a delineation of its scope.

In general terms, the present disclosure is based on the idea of pulling the sewing thread being brought through the free loop.

Particularly, an aspect provides a method for sewing blocks of signatures, wherein for each block of signatures a portion of each sewing thread is brought through a corresponding free loop, the sewing thread is blocked, cut and pulled for tightening the free loop around the sewing thread being cut.

A further aspect provides a corresponding sewing station.

A further aspect provides a bookbinding sewing machine comprising this sewing station.

More specifically, one or more aspects of the present disclosure are set out in the independent claims and advantageous features thereof are set out in the dependent claims, with the wording of all the claims that is herein incorporated verbatim by reference (with any advantageous feature provided with reference to any specific aspect that applies mutatis mutandis to every other aspect).

BRIEF DESCRIPTION OF THE DRAWINGS

The solution of the present disclosure, as well as further features and the advantages thereof, will be best understood with reference to the following detailed description thereof, given purely by way of a non-restrictive indication, to be read in conjunction with the accompanying drawings (wherein, for the sake of simplicity, corresponding elements are denoted with equal or similar references and their explanation is not repeated, and the name of each entity is generally used to denote both its type and its attributes—like value, content and representation). In this respect, it is expressly intended that the drawings are not necessary drawn to scale (with some details that may be exaggerated and/or simplified) and that, unless otherwise indicated, they are merely used to illustrate the structures and procedures described herein conceptually. Particularly.

DETAILED DESCRIPTION

Figure 1:
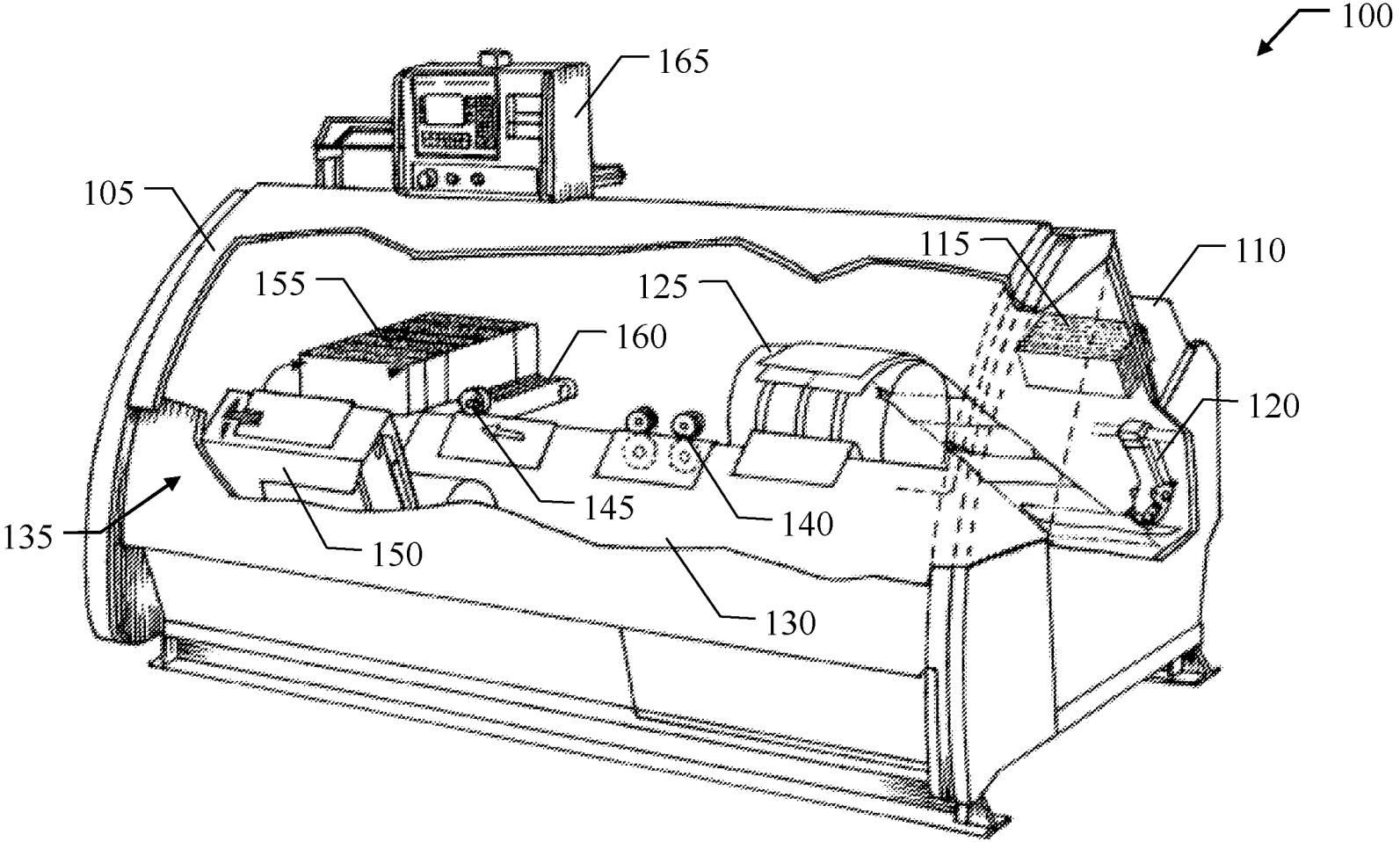
FIG. 1 shows a pictorial representation of a sewing machine wherein the solution according to an embodiment of the present disclosure may be applied.

With reference in particular to FIG. 1, a pictorial representation is shown of a (bookbinding) sewing machine 100 wherein the solution according to an embodiment of the present disclosure may be applied.

The sewing machine 100 is used for sewing blocks of signatures to each other, so as to form book blocks for the production of corresponding books of sewn type (not shown in the figure); for example, each signature is formed by a printed sheet, which is folded one or more times to define different pages of the books.

The sewing machine 100 comprises a bearing frame 105 for its components, which is provided with a carter for covering them. Particularly, a hopper 110 is used to load a stack of signatures to be sewn, denoted with the reference 115 (ordered according to the book blocks to be formed). An extraction device 120 (for example, based on a pair of pliers and a series of suction cups) extracts the signatures 115 in succession from the bottom of the hopper 110 and provides them to an opening device 125; in turn, the opening device 125 (for example, based on a series of upper and lower suction cups) opens each signature 115 and places it astride a fixed saddle 130. The fixed saddle 130 conveys the signatures 115 to a sewing station 135. In detail, the fixed saddle 130 comprises a saddle plate (wedge-shaped, inverted-V-like) for resting the signatures 115; a chain with pushing pegs (not shown in the figure) is housed inside the saddle plate, so that the pegs project through a longitudinal slot of the saddle plate, corresponding to a vertex thereof, for pushing the signatures 115 (leftwards in the figure). The signatures 115 conveyed by the fixed saddle 130 cross a shaping station 140, and then reach a launching wheel 145, which accelerates each signature 115 so as to separate it from the previous ones and throw it individually over a movable saddle 150 of the sewing station 135 (in an open position aligned with the fixed saddle 130); the movable saddle 150 as well comprises a saddle plate (wedge-shaped, inverted-V-like) for resting the signatures 115, which has a longitudinal slot, corresponding to a vertex thereof, for the passage of (mechanical) members of the sewing station 135. Once the signature 115 has been loaded astride the movable saddle 150, the latter is raised to bring it towards a closed position under a sewing head (not shown in the figure); the sewing head sews the signature 115 loaded on the movable saddle 150 by continuous (sewing) threads, starting a new book block if the signature 115 is the first one thereof or adding the signature 115 to a book block under formation otherwise; the movable saddle 150 then returns to the open position (by slipping out of the signature 115 just sewn) to repeat the same operations continually. As soon as each book block is completed, the threads are cut to separate it therefrom. The book blocks so obtained, denoted with the reference 155, are deposited in succession onto an output conveyor 160 (to be provided to further machines, not shown in the figure, which complete the corresponding books). A motor, not visible in the figure, drives the various (mechanical) members of the sewing machine 100 by means of corresponding transmission systems. Operation of the entire sewing machine 100 is managed by a control system 165 (for example, based on an industrial PC).

Figure 2:
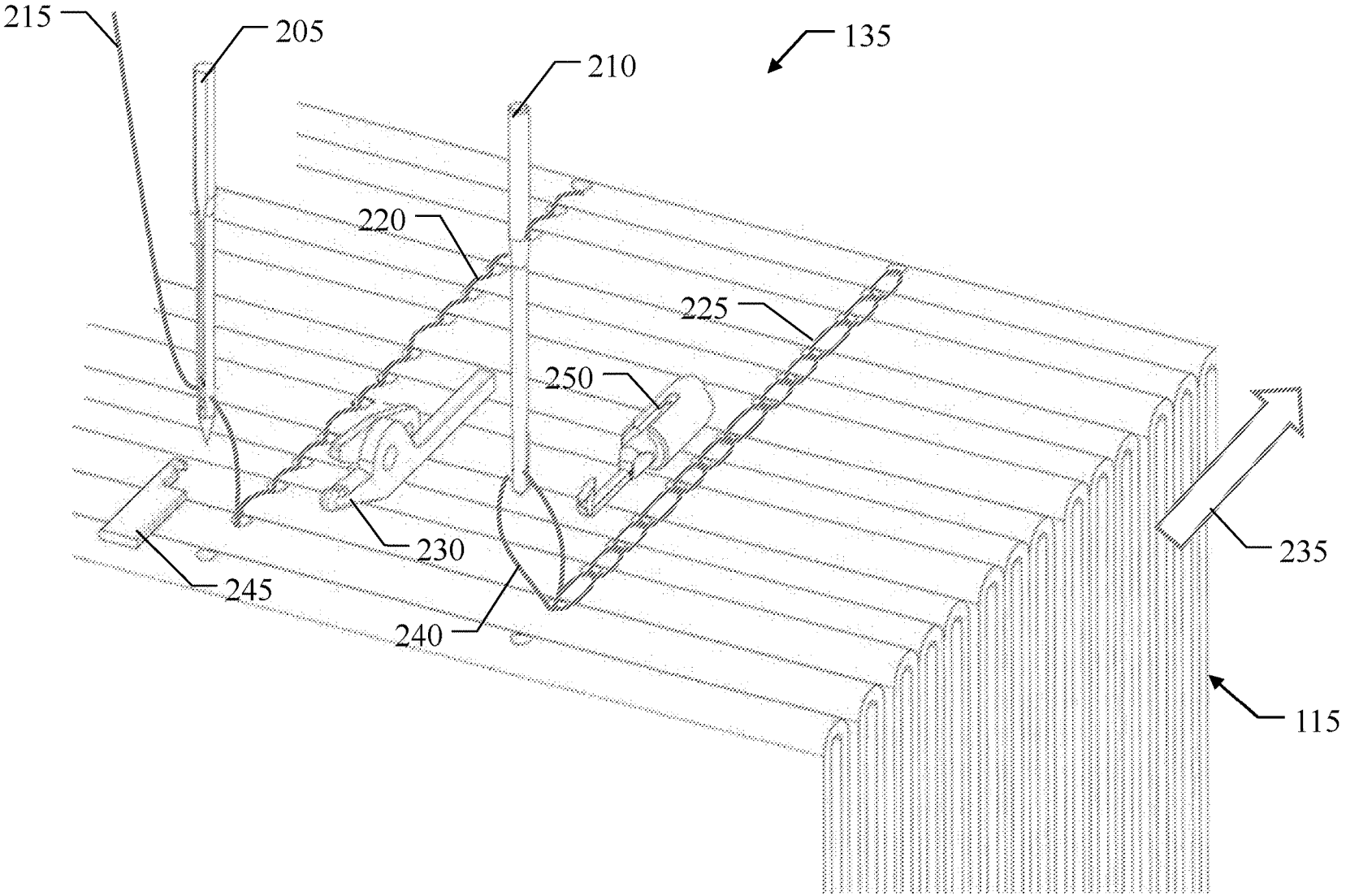
FIG. 2 shows a simplified representation of a portion of a sewing station according to an embodiment of the present disclosure.

With reference now to FIG. 2, a simplified representation is shown of a portion of the sewing station 135 according to an embodiment of the present disclosure.

The sewing station 135 comprises a series of needles 205 and a series of crochets 210 alternated to each other (for example, 8-15 pairs each formed by a needle 205 and a following crochet 210, for example, to the right, only one of them shown in the figure). The needles 205 are formed by a stem that ends with a tip provided with an eye for inserting corresponding sewing threads, denoted with the reference 215, which are supplied continuously (for example, by corresponding spools not shown in the figure); the crochets 210 are formed by a similar stem that instead ends with a hook for hooking the threads 215. The needles 205 and the crochets 210 cooperate to convey the threads 215 through the signatures 115 so as to form one or more stitchings that bridge between them; particularly, the stitchings comprise one or more rows of plain stitches 220 (formed by the needles 205) and one or more rows of looped stitches 225 (formed by the crochets 210), which are concatenated to each other. The needles 205 and the crochets 210 are mounted onto a support bar (not shown in the figure) arranged above the movable saddle (not shown in the figure) in its closed position, so that in rest condition the needles 205 and the crochets 210 are raised above the movable saddle; this support bar implements a mechanism of translation in vertical of the needles 205 and the crochets 210 and of rotation around a longitudinal axis thereof of the crochets 210. Moreover, the sewing station 135 comprises a series of cutters 230 (only one of them shown in the figure), each for cutting a corresponding thread 215 at the end of each book block. The cutters 230 (for example, of active type formed by scissors) are mounted onto a support bar (not shown in the figure) arranged above the movable saddle in its closed position, so that in rest condition each cutter 230 is between the needle 205 and the crochet 210 of a corresponding pair (slightly below their tips) behind them along an advancement direction 235 of the signatures 115 during their sewing (backwards in the figure); this support bar implements a mechanism of translation in horizontal, in parallel to the advancement direction 235, and of actuation of the cutters 230.

The sewing station 135 also comprises a series of shuttles (not visible in the figure) for conveying corresponding threads 215 from the needles 205 to the adjacent crochets 210 inside the movable saddle; these shuttles are mounted onto a support bar (not shown in the figure) arranged within the movable saddle, which implements a mechanism of translation in horizontal, perpendicularly to the advancement direction 235, of the shuttles 235.

Each signature 115 to be sewn (in front in the figure) is stopped at the desired position along the movable saddle by a square register and it is maintained pressed thereon by a comb insert (not shown in the figure); a series of holes are formed in a back of the signature 115 for the needles 205 and the crochets 210 by corresponding punches arranged inside the movable saddle (not visible in the figure). At the beginning of the sewing of each book block, the threads 215 (coming from the corresponding spools) cross the eye of the corresponding needles 205 and end with a free tail (because just inserted into the needles 205 at the beginning of a processing batch or because cut at the end of the sewing of a previous book block), while the hook needles 210 are free; later on, the threads 215 extend from the corresponding needles 205 to the corresponding plain stitches 220 formed onto a preceding signature 115, while corresponding free loops 240 previously formed by the threads 215 are held by the crochets 210 (with the hook facing along the advancement direction 235, backwards in the figure).

The sewing station 135 may implement a normal stitch sewing technique or a stagger stitch sewing technique.

In the normal stitch sewing technique, each needle 205 always cooperates with the following crochet 210, so that the plain stitches 220 formed by the needle 205 are concatenated only with the looped stitches 225 formed by this crochet 210. Particularly, the stitchings are made by corresponding pairs of (adjacent) needles 205 and crochets 210. During each operating cycle of the sewing machine, for each stitching the needle 205 and the crochet 210 are lowered (after rotating the crochet 210 by 180°), so as to penetrate into the signature 115 (through the corresponding holes). In this way, the thread 215 is pushed into the signature 115 by the needle 205, while the free loop 240 remains wound around the crochet 210 outside the signature 115. The thread 215 within the signature 115 is conveyed from the needle 205 to the crochet 210 by the corresponding shuttle. The needle 205 and the crochet 210 are raised so as to exit from the signature 115; in this phase, the crochet 210 hooks the thread 215 and extracts it from the signature 115 so as to form a new free loop 240 that is concatenated with the previously free loop (at the same time with the crochet 210 that rotates by 180° for returning to its initial position). The movable saddle is then opened to load a next signature 115 to be sewn, with the signature 115 just sewn that slips out of the movable saddle. The movable saddle is then closed to bring the next signature 115 under the needles 205 and the crochets 210, with all the signatures 115 already sewn that advance along the direction 235 (so as to move away from the needles 205 and the crochets 210).

In the stagger stitch sewing technique, instead, each needle 205 alternately cooperates with a preceding crochet 210 and with a following crochet 210 (to the left and right, respectively), so that the simple stitches 220 formed by the needle 205 are concatenated alternately with the looped stitches 225 formed by these crochets 210. Particularly, the stitchings are made by a series of adjacent needles 205 and crochets 210 that starts and ends with a needle 205. In this case, the threads 215 within the signature 115 are brought alternately from the needles 205 to the preceding crochets 210 (with the exception of a first needle 205) and from the needles 205 to the following crochets 210 (with the exception of a last needle 205).

In both cases, the above-described operations are repeated continually for each new signature 115 that is fed by the movable saddle. Once a last signature of each book block 115 has been sewn, the book block is completed by separating it from the threads 215.

For this purpose, in the solution according to an embodiment of the present disclosure, the sewing station 135 comprises a series of (auxiliary) shuttles 245 (only one of them shown in the figure), each for carrying a corresponding thread 215 from the needle 205 to the following crochet 210 outside of the movable saddle, above the comb insert. The shuttles 245 are mounted onto a support bar (not shown in the figure) arranged above the movable saddle in its closed position, so that in rest condition each shuttle 245 is beside the corresponding needle 205 (transversely to the advancement direction 235) at the opposite side of the following crochet 210 (to the left in the figure); this support bar implements a mechanism of translation in horizontal, obliquely to the advancement direction 235, of the shuttles 245. In addition, the sewing station 135 comprises a series of gripping devices (thread-clamps) 250, each for blocking and pulling a corresponding thread 215. The thread-clamps 250 are mounted onto a support bar (not shown in the figure) arranged above the movable saddle in its closed position, so that in rest condition each clamp-thread 250 is beyond a corresponding crochet 210 along the advancement direction 235 (slightly below its tip); this support bar implements a mechanism of translation in horizontal, in parallel and transversely to the advancement direction 235, and of actuation of the thread-clamps 250.

With reference now to FIG. 3A-FIG. 3E, the main steps are shown of the completion of a book block sewn with the normal stitch technique according to an embodiment of the present disclosure.

Figure 3A:
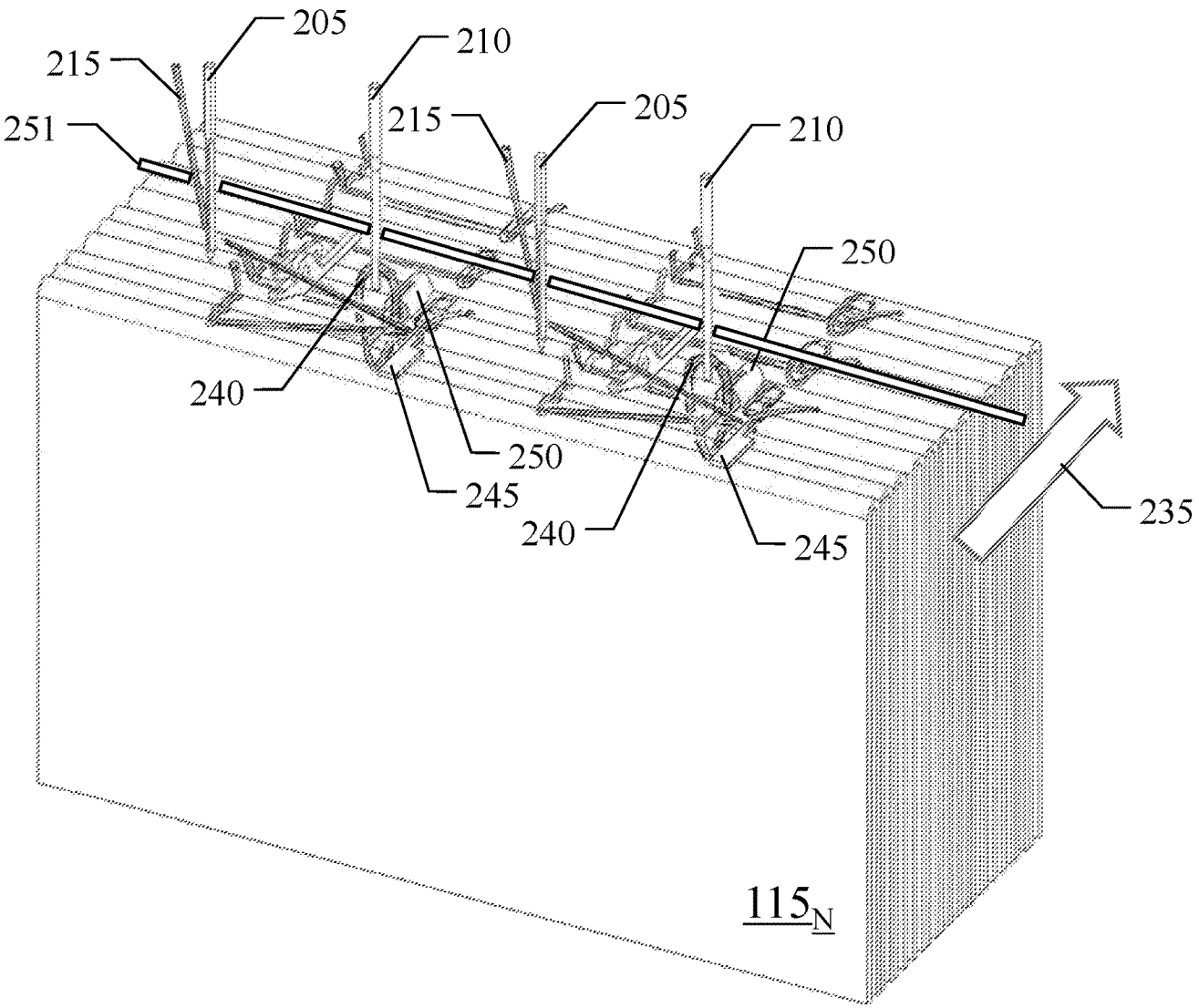
FIG. 3A-FIG. 3E show the main steps of the completion of a book block sewn with a normal stitch technique according to an embodiment of the present disclosure.

Starting from FIG. 3A, for each stitching (two of them shown in the figures), once a last signature of the block, differentiated with the reference $\mathbf{115}_N$, has been sewn the thread 215 extends from the (last) signature $\mathbf{115}_N$ to the spool passing through the eye of the needle 205 while its free loop 240 is held by the crochet 210. At this point, the shuttle 245 is translated towards the crochet 210 (rightwards in the figure). In this way, the shuttle 245 hooks the thread 215 (between the signature $\mathbf{115}_N$ and the needle 205); the shuttle 245 then pulls the thread 215 (pulling it out from the spool, not shown in the figure) so as to tighten a lower portion thereof between the signature $\mathbf{115}_N$ and the shuttle 245 and an upper portion thereof between the shuttle 245 and the needle 205. The shuttle 245 moves obliquely to the direction 235 (backwards), so as to form with it an angle higher than 90° (for example, of the order of 95°-125°, preferably 100°-120° and still more preferably 105°-115°, such as 110°); accordingly, the shuttle 245 goes beyond the crochet 210, so as to pull the thread 215 towards an (intermediate) position behind the free loop 240, along the direction 235 (for example, 1-3 mm from it). Subsequently, the thread-clamp 250 is translated in the opposite direction to the direction 235 (forwards in the figure), so as to be inserted into the free loop 240; the thread-clamp 250 passes through the free loop 240 up to hook the thread 215 (for example, going beyond its upper portion by 1-2 mm).

Figure 3B:
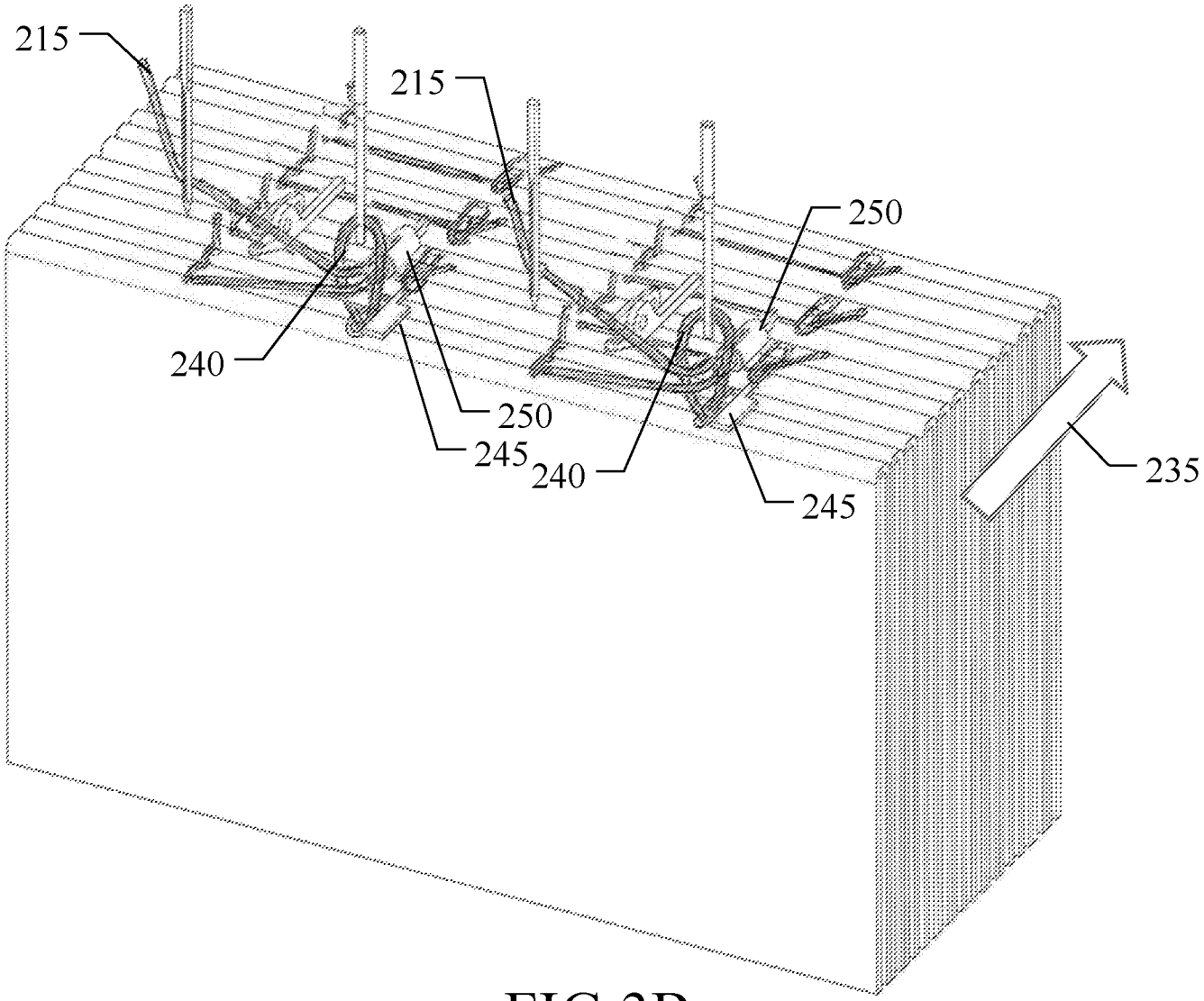

Passing to FIG. 3B, the thread-clamp 250 is actuated so as to grip the thread 215, blocking it at a (gripping) point thereof. The thread-clamp 250 is then moved along the direction 235 (backwards in the figure) so as to be extracted from the free loop 240 (for example, moving away by 1-3 mm from it); as a consequence, the thread-clamp 250 pulls the thread 125 through the free loop 240. In this way, a (closing) portion of the thread 215, comprising the gripping point, is brought within the free loop 240; the closure portion of the thread 215 is downstream the plain stitches 220 along their formation direction (i.e., from the plain stitches 220 to the needle 205), opposite the direction of unwinding of the thread 215 from the spool. In this way, the double movement of the thread 215 (at first from the needle 205 to the intermediate position and then towards the free loop 240) allows inserting the thread 215 through the free loop 240 in a simple and effective way (maintaining the free loop 240 in its normal position). The above-described operations may be carried out during the (normal) operating cycles of the sewing machine (not shown in the figure), in an interval between the operating cycle for sewing the signature $\mathbf{115}_N$ and the operating cycle for sewing a first signature of a next block (not shown in the figure), while the needles 205 and the crochets 210 are raised to exit from the signature $\mathbf{115}_N$ and are lowered to enter the first signature of the next block.

Figure 3C:
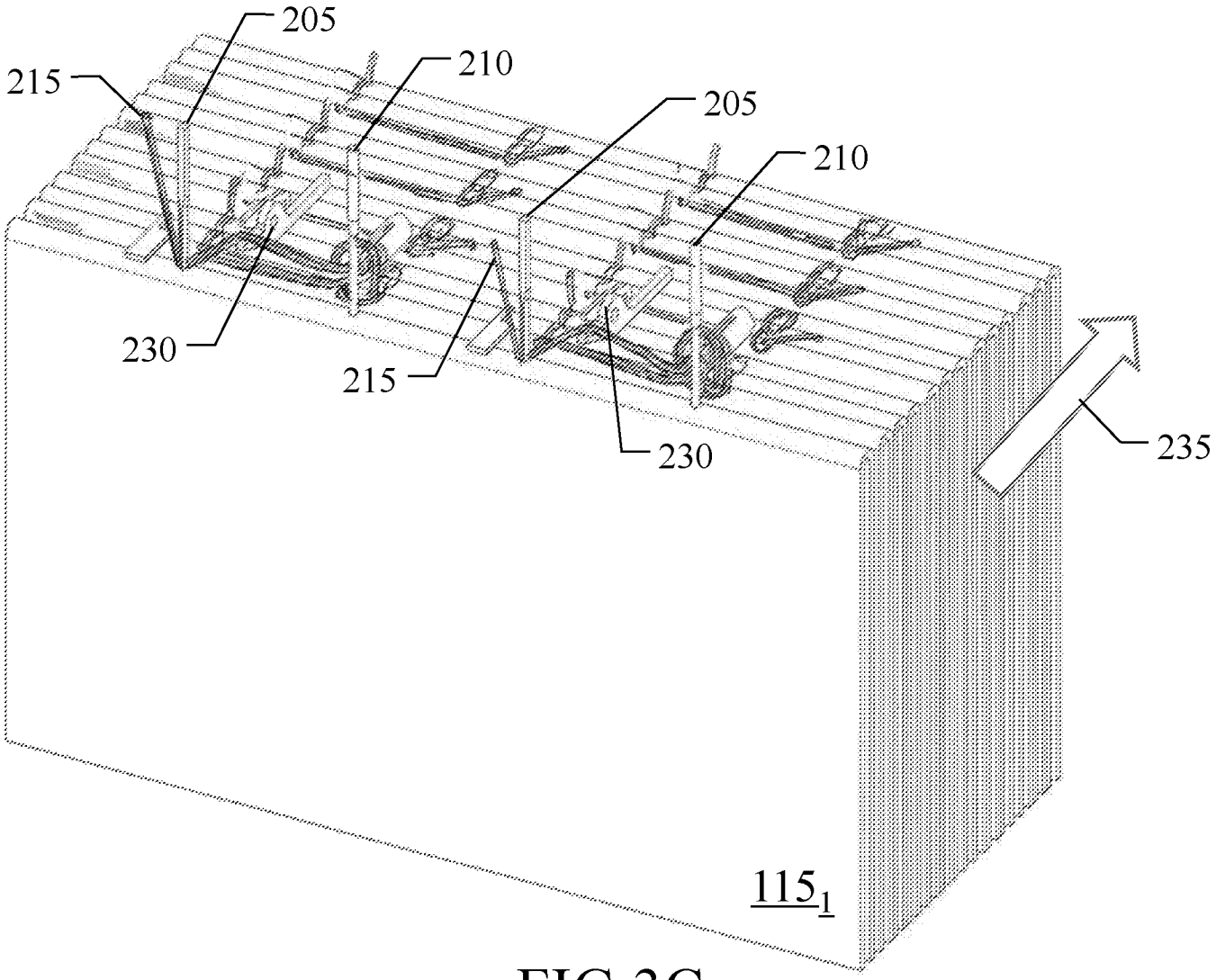

Passing to FIG. 3C, the sewing of the next block of signatures is started, with the needle 205 and the crochet 210 that are inserted into its first signature, differentiated with the reference 1151. At the same time, the cutter 230 is translated in the opposite direction to the direction 235 (forwards in the figure) up to reach the thread 215 (for example, with its upper portion that rests onto a lower blade of the cutter 230).

Figure 3D:
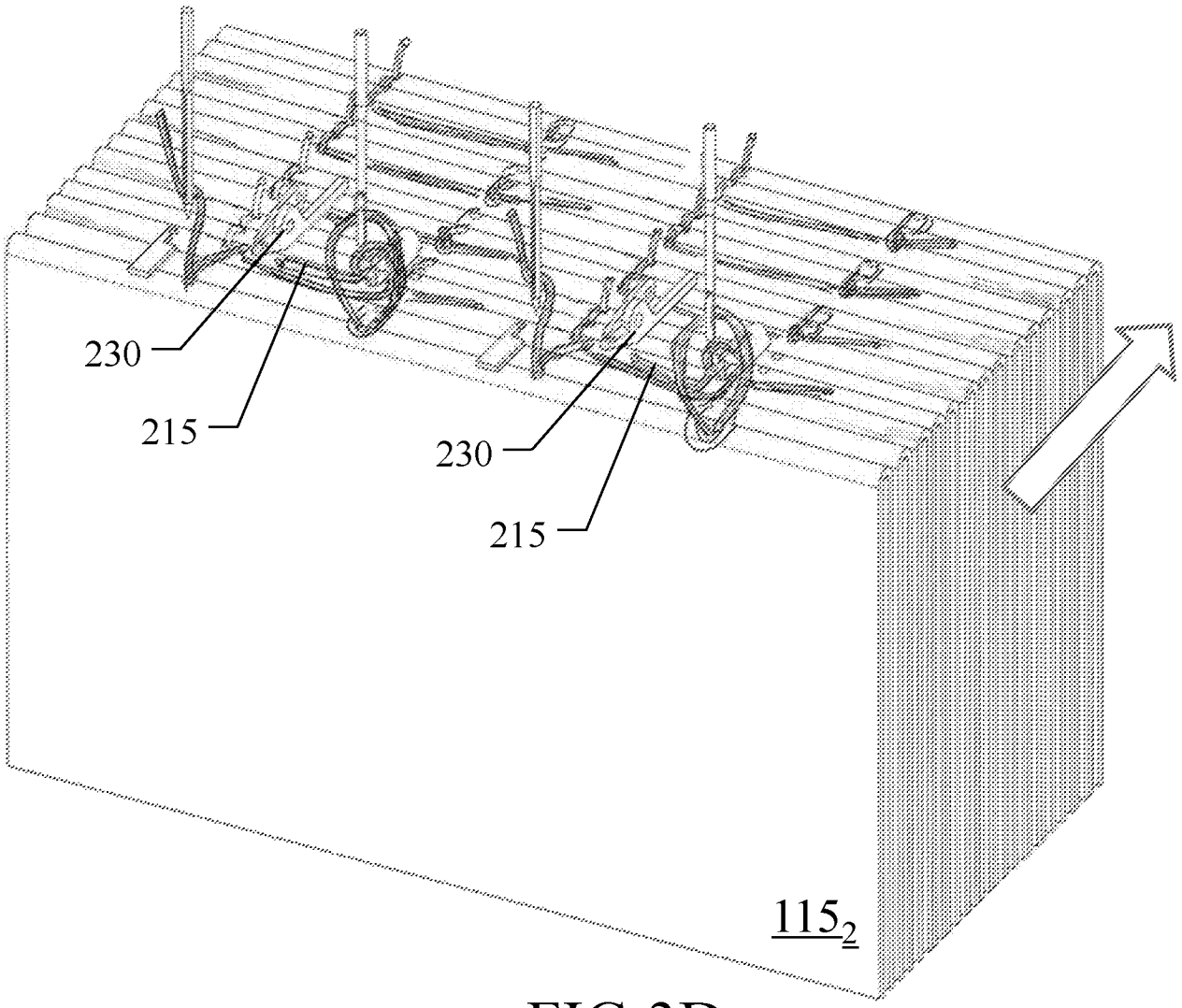

Passing to FIG. 3D, after sewing one or more signatures of the next block, for example, after sewing a second signature thereof, differentiated with the reference 1152, the cutter 230 is actuated; for example, an upper blade of the cutter 230 is lowered against its lower blade, so as to cut the thread 215 comprised between them. In this way, the thread 215 is cut after it has been blocked by the thread-clamp 250 (downstream its gripping point), so that no risk exists that it might be lost.

Figure 3E:
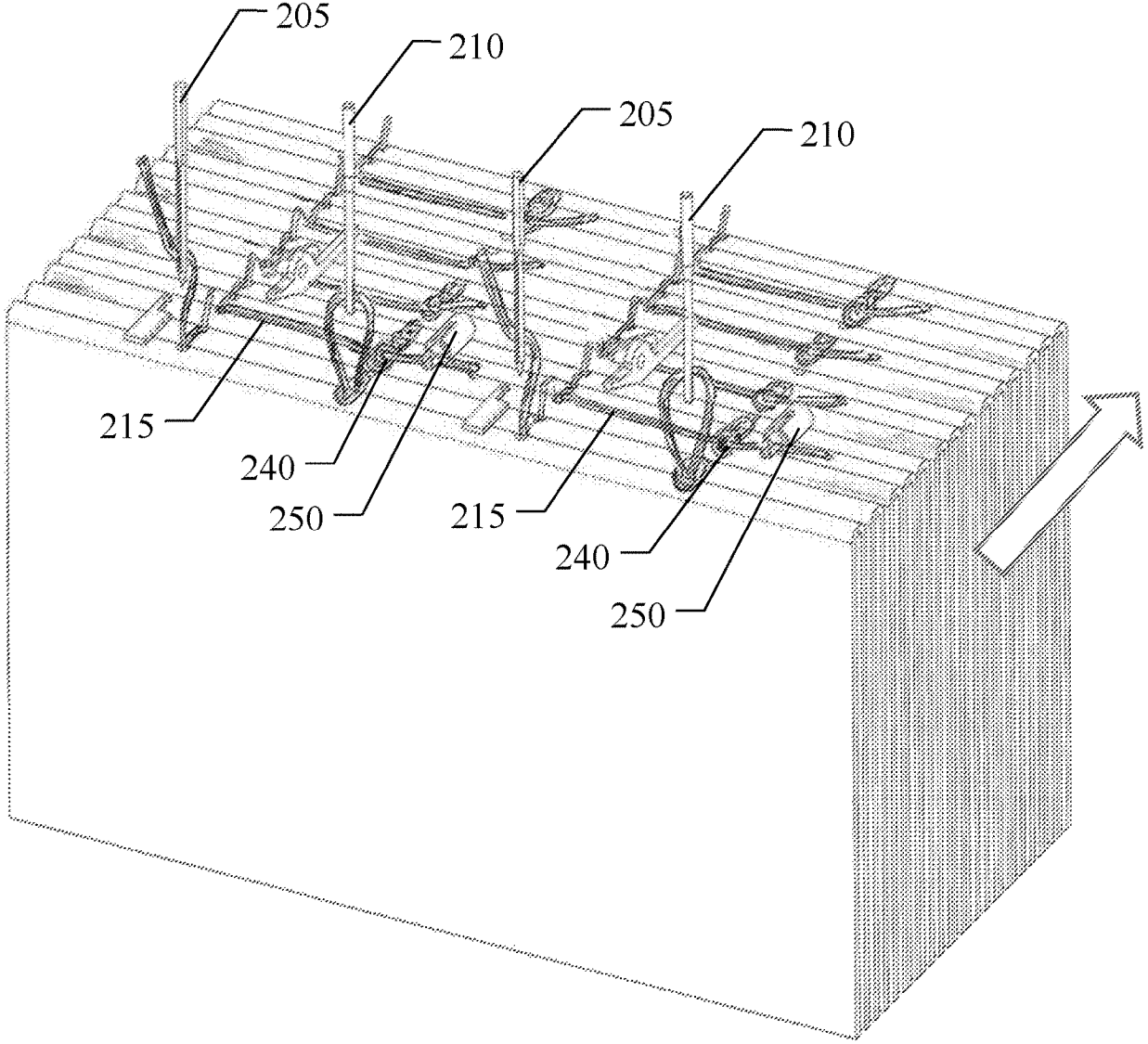

Passing to FIG. 3E, at this point the thread-clamp 250 is translated laterally away from the crochet 210 (in order to limit the amount of space); for example, the thread-clamp 250 is translated to the opposite side of the needle 205 (rightwards in the figure) for a distance almost equal to the distance between the needle 205 and the crochet 210. As a consequence, the (cut) thread 215 is pulled (without sliding with respect to the thread-clamp 250 that blocks it) so as to tighten the free loop 240 around it (as described in detail in the following). Subsequently, the actuation of the thread-clamp 250 is ceased so as to release the thread 215 that slips out thereof.

Figure 4A:
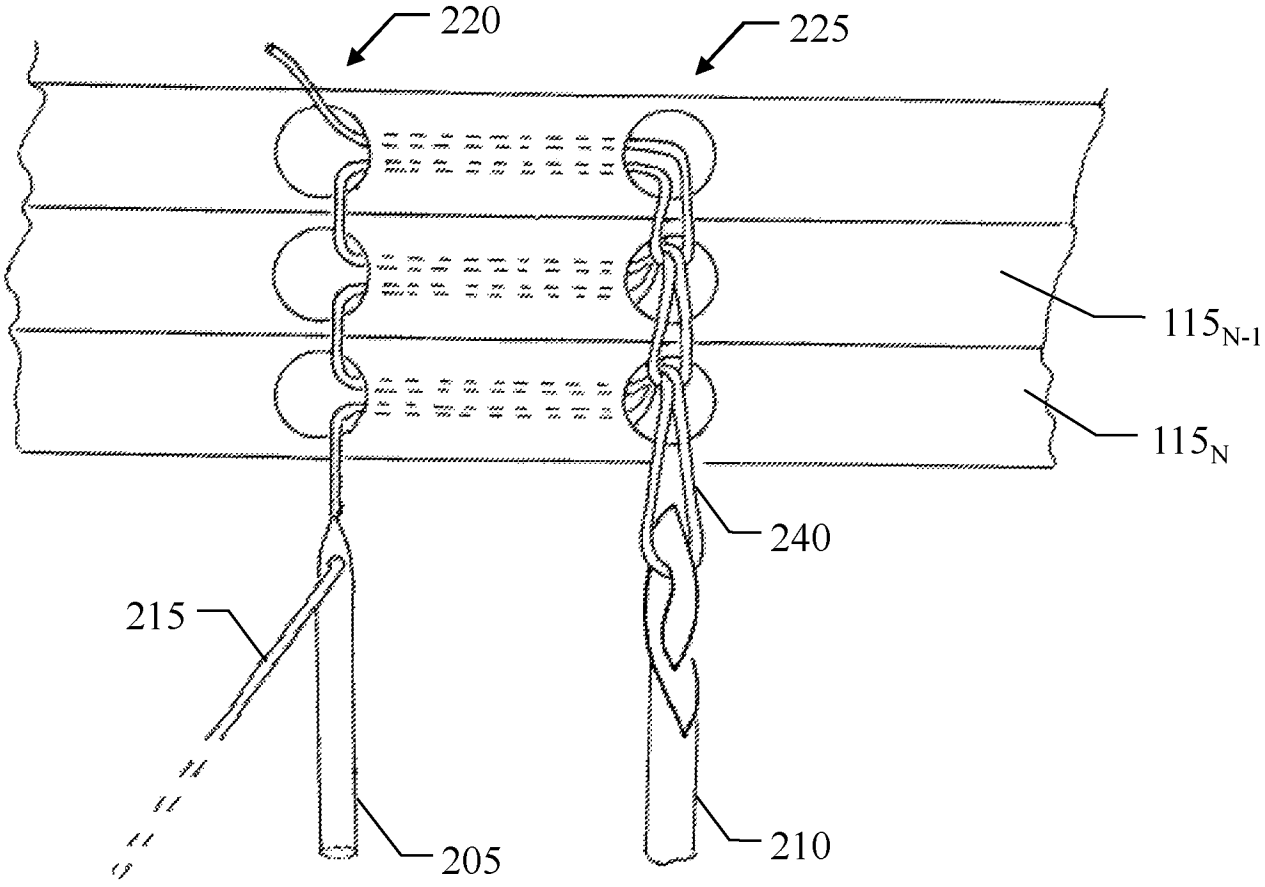
FIG. 4A-FIG. 4B show a partial representation of the condition preceding and following, respectively, the completion of a book block sewn with the normal stitch technique in the solution according to an embodiment of the present disclosure.
Figure 4B:
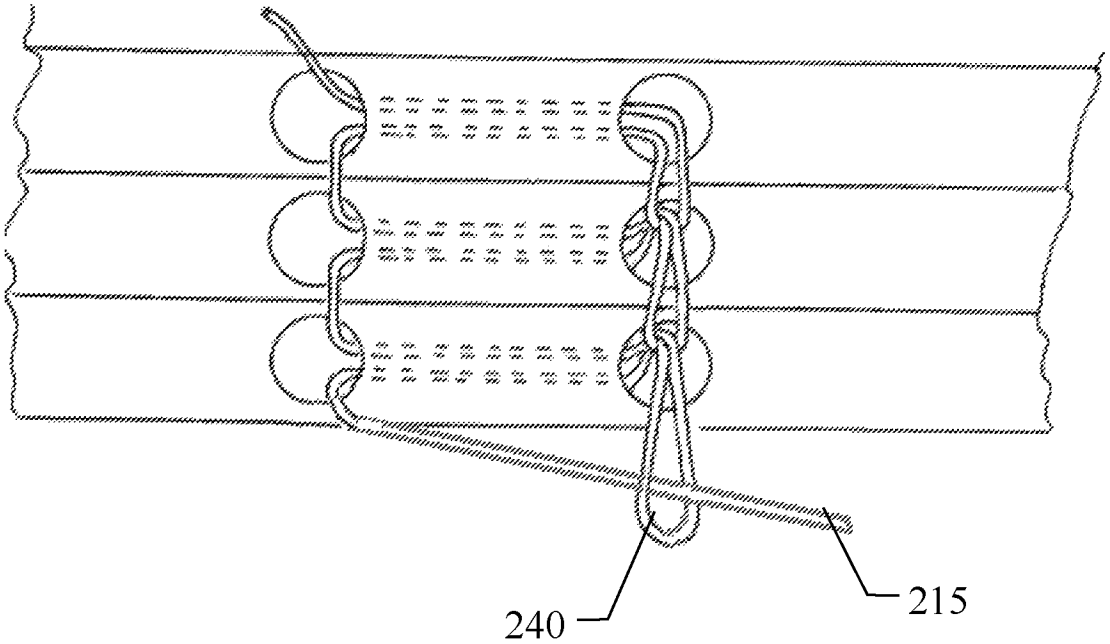

With reference now to FIG. 4A-FIG. 4B, a partial representation is shown of the condition preceding and following, respectively, the completion of a book block sewn with the normal stitch technique in the solution according to an embodiment of the present disclosure.

Starting from FIG. 4A, the condition is shown just after the (last) signature $\mathbf{115}_N$ has been sewn. For each stitching (only one shown in the figure), starting from the looped stitches 225 corresponding to a penultimate signature of the block, differentiated with the reference $\mathbf{115}_{N-1}$, the thread 215 enters the (penultimate) signature $\mathbf{115}_{N-1}$, crosses it towards the needle 205 (leftwards) and exits therefrom; the thread 215 then enters the signature $\mathbf{115}_N$, crosses it towards the crochet 210 (rightwards) and exits therefrom. At this point, the thread 215 forms the free loop 240, which is held by the crochet 210, enters the signature $\mathbf{115}_N$ again, crosses it towards the needle 205 (rightwards) and exits therefrom; the thread 215 then passes through the eye of the needle 205 and continues up to the spool (not shown in the figure).

Passing to FIG. 4B, the condition is shown following the completion of the book block. As described above, the thread 215 is brought into the free loop 240, blocked, cut and then pulled (away from the free loop 240). As a consequence, the traction applied to the thread 215 closes the free loop 240, by tightening it around the thread 215. Particularly, the (blocked) thread 215 is pulled to a distance from the free loop 240 substantially equal to the distance between the needle and the crochet (not shown in the figure), which is then higher than the length of a free portion (tail) of the thread 215 (downstream its gripping point), since the thread 215 is cut at a point between the needle and the crochet (for example, with this distance equal to 2-4 times the length of the free tail); in this way, the free tail of the thread 215 is slipped out of the free loop 240 thereby improving the grip of the (closed) free loop 240 around the thread 215. At the same time, the length of the free tail of the thread 215 (in any case cut downstream its closing portion being brought through the free loop 240) is sufficient to ensure a good grip of the free loop 240 thereon. Moreover, the fact that the thread 215 is pulled to the opposite side of the needle further facilitates the closure of the free loop 240.

The above-described solution allows avoiding performing the blind stitch after sewing the last signature of each block; this significantly increases the performance of the sewing machine, especially in the case of small books (wherein each book block is formed by a reduced number of signatures).

This result is obtained without the use of glue; this avoids dirtying the members of the sewing machine and interfering with the opening of the books.

Moreover, this result is obtained without requiring the use of special threads; this avoids affecting the operating costs of the sewing machine (and therefore of the produced books).

Figure 5A:
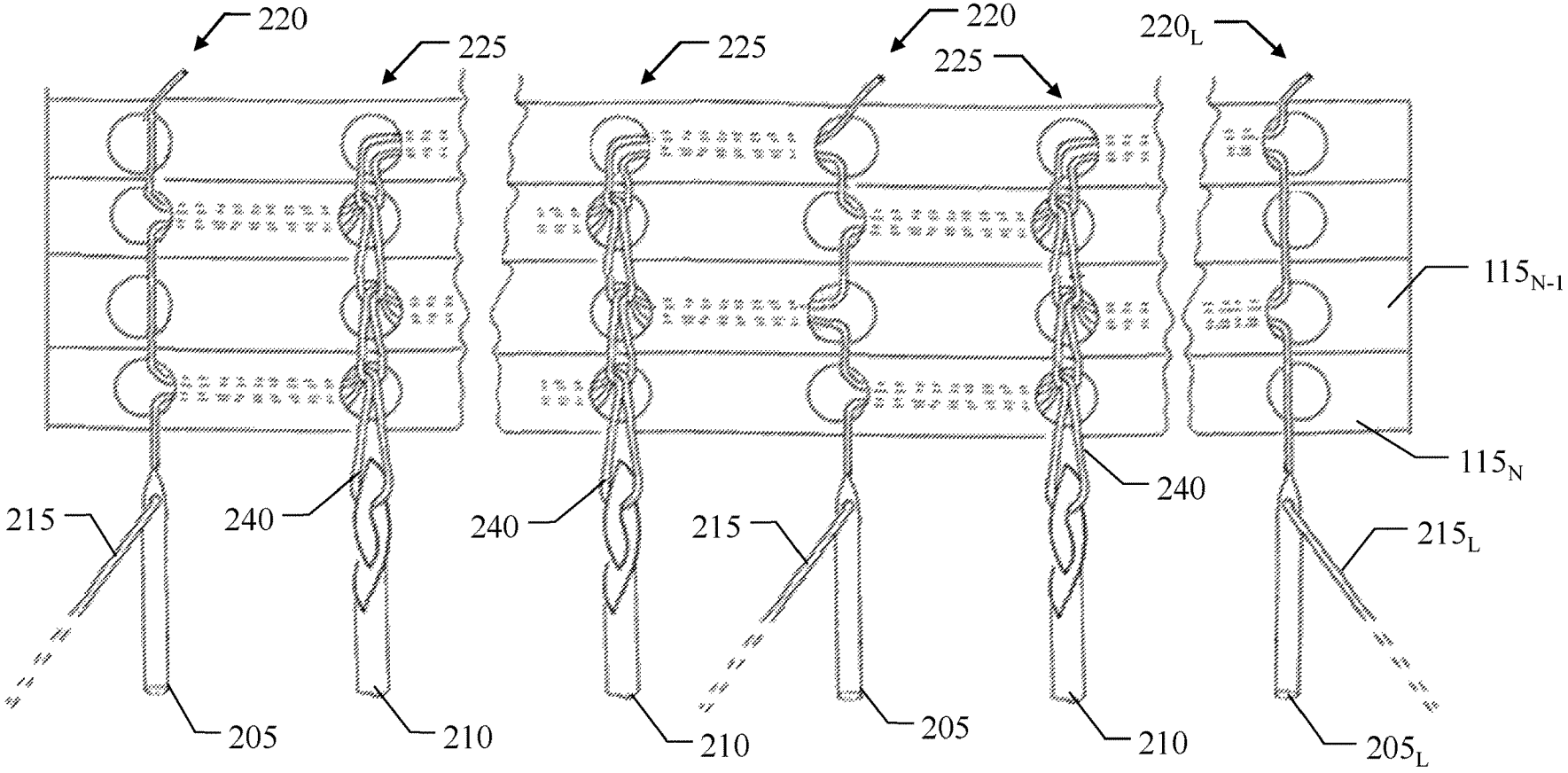
FIG. 5A-FIG. 5B show a partial representation of the condition preceding and following, respectively, the completion of a book block sewn with a stagger stitch technique in the solution according to an embodiment of the present disclosure.
Figure 5B:
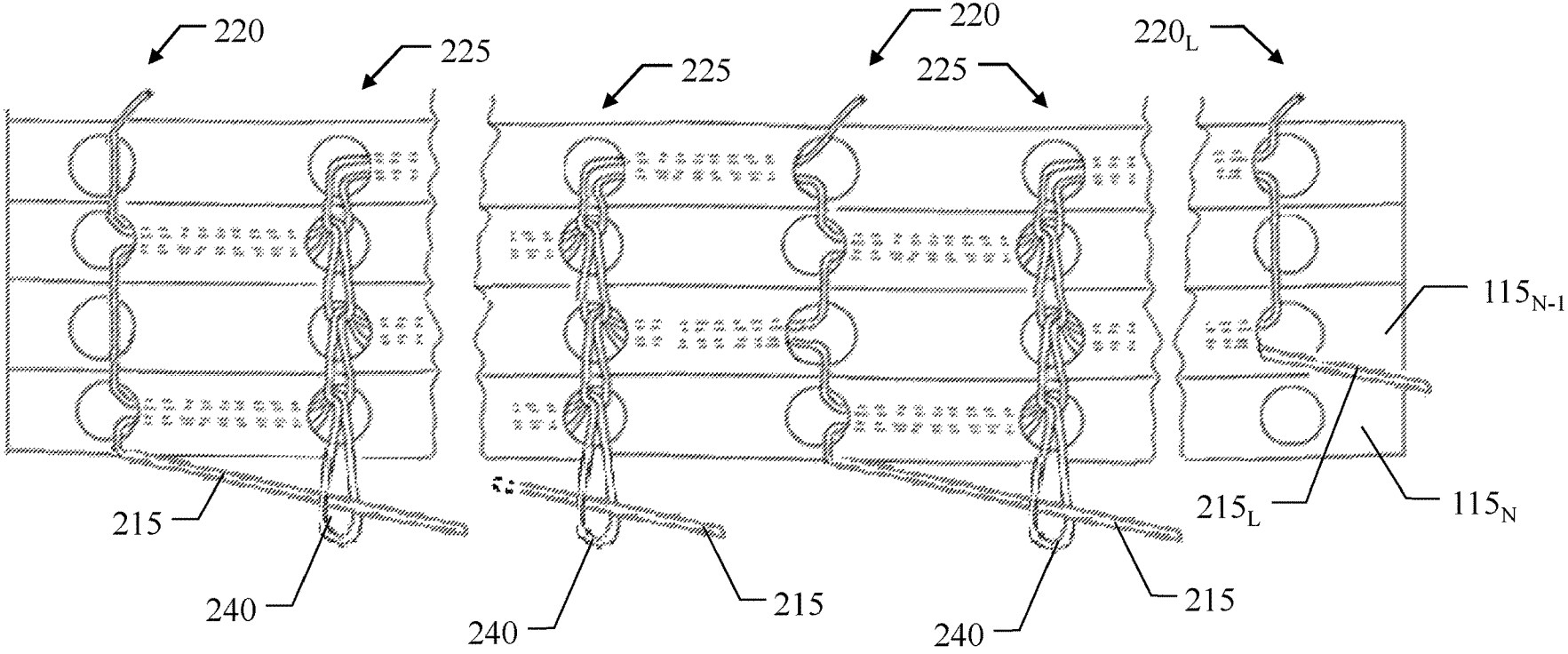

The above-described solution is very effective. Particularly, the free loop tightened around the thread significantly increases its gripping; this avoids (or at least substantially reduces) the risk that the stitchings may loosen during the next processing phases of the book blocks and therefore compromise their compactness and integrity. With reference now to FIG. 5A-FIG. 5B, a partial representation is shown of the condition preceding and following, respectively, the completion of a book block sewn with a stagger stitch technique in the solution according to an embodiment of the present disclosure.

Starting from FIG. 5A, the plain stitches 220 formed by the thread 215 of each intermediate needle 205 (different from the first one and the last one) are similar to the previous case, with the only difference that they are alternately concatenated with the looped stitches 225 formed by the preceding crochet 210 and the following crochet 210. Instead, the plain stitches 220 formed by the thread 215 of the first needle 205 (on the left in the figure) skip a signature every time the threads are brought to the preceding crochets 210, since not available for the first needle 205; vice-versa, the plain stitches formed by the thread of the last needle (on the right in the figure), differentiated with the references $\mathbf{220}_L$, $\mathbf{215}_L$ and $\mathbf{205}_L$, respectively, skip a signature every time the threads are brought to the following crochets, since not available for the needle $\mathbf{205}_L$. In the figure, the condition is shown just after the (last) signature $\mathbf{115}_N$ has been sewn, in the case wherein in the signature $\mathbf{115}_N$ the threads 215 have been brought from the needles 205 to the following crochets 210, rightwards (dual considerations apply to the opposite case). Therefore, for each pair formed by a needle 205 and the following crochet 210, the thread 215 is in a condition similar to that described above; as regards instead the needle $\mathbf{205}_L$, starting from the loop stitches 225 corresponding to the (penultimate) signature $\mathbf{115}_{N-1}$, the thread $\mathbf{215}_L$ enters the signature $\mathbf{115}_{N-1}$, crosses it towards the needle $\mathbf{205}_L$ (rightwards), exits therefrom and directly reaches the eye of the needle $\mathbf{205}_L$, skipping the signature $\mathbf{115}_N$, to continue thus up to the spool (not shown in the figure).

Passing to FIG. 5B, the condition is shown following the completion of the book block. For each pair formed by a needle and the following crochet (not shown in the figure), as above the thread 215 is brought into the free loop 240, blocked, cut and pulled so as to tighten the free loop 240 around the thread 215. As regards instead the last needle (not shown in the figure), the thread $\mathbf{215}_L$ is not pulled (for example, by disabling the actuation of the corresponding thread-clamp, not shown in the figure). Indeed, in this case the thread $\mathbf{215}_L$ does not form any free loop, so that if the thread $\mathbf{215}_L$ was pulled there would be a risk of tearing it. As a consequence, the (cut) thread $\mathbf{215}_L$ is simply left free outside the signature $\mathbf{115}_{N-1}$ (in any case remaining blocked within the looped stitches 225 in correspondence thereof).

Figure 6A:
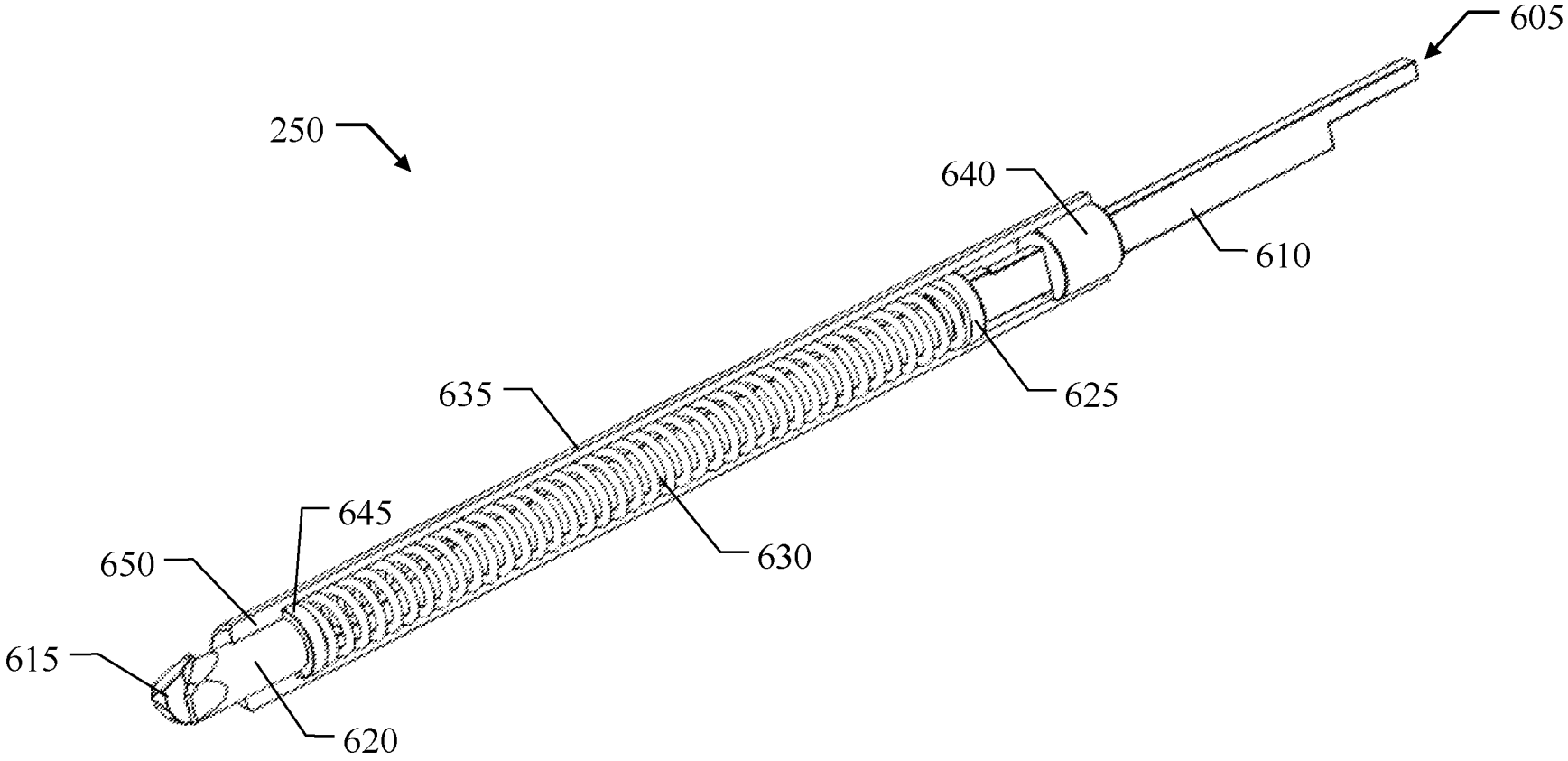
FIG. 6A-FIG. 6C show a pictorial representation in cross section of a thread-clamp that may be used to implement the solution according to an embodiment of the present disclosure in different operating conditions.
Figure 6B:
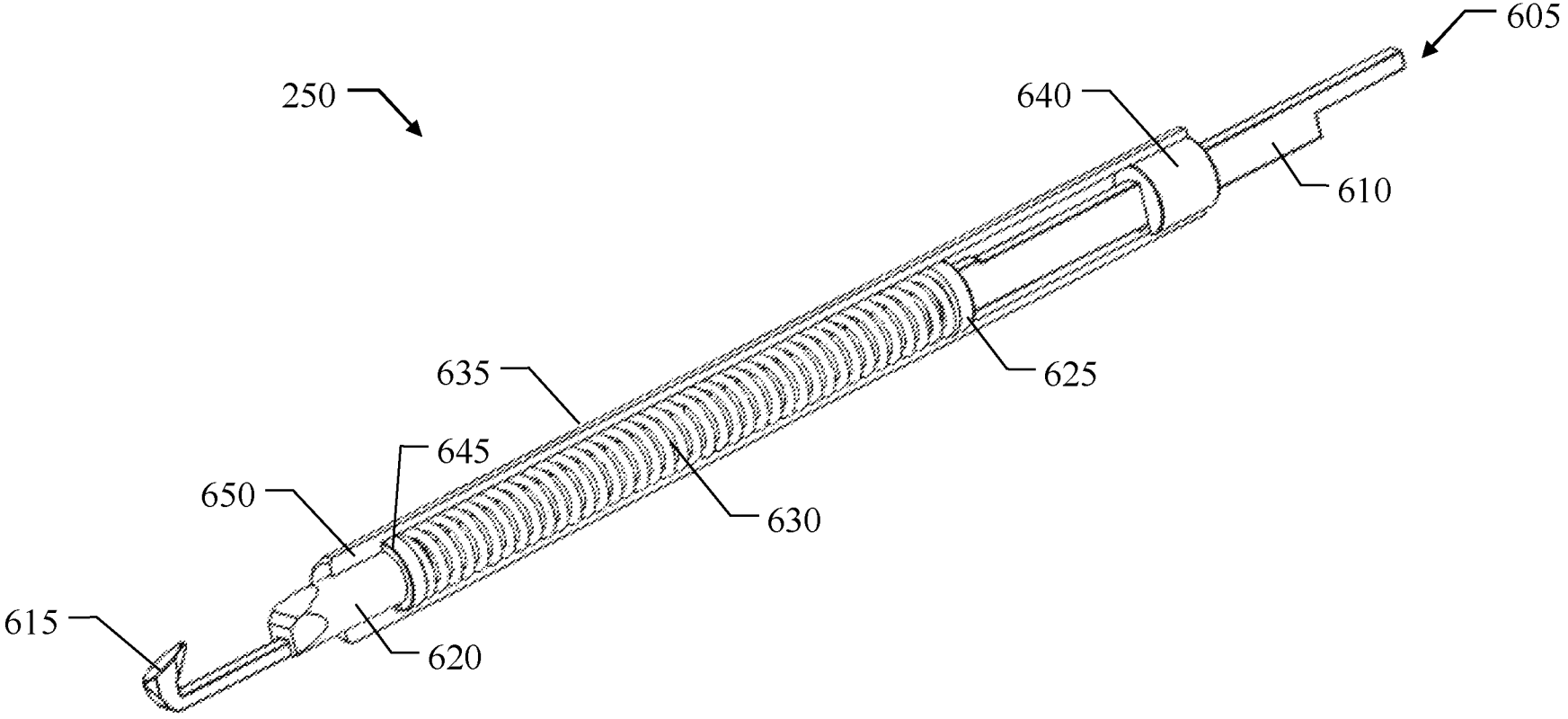
Figure 6C:
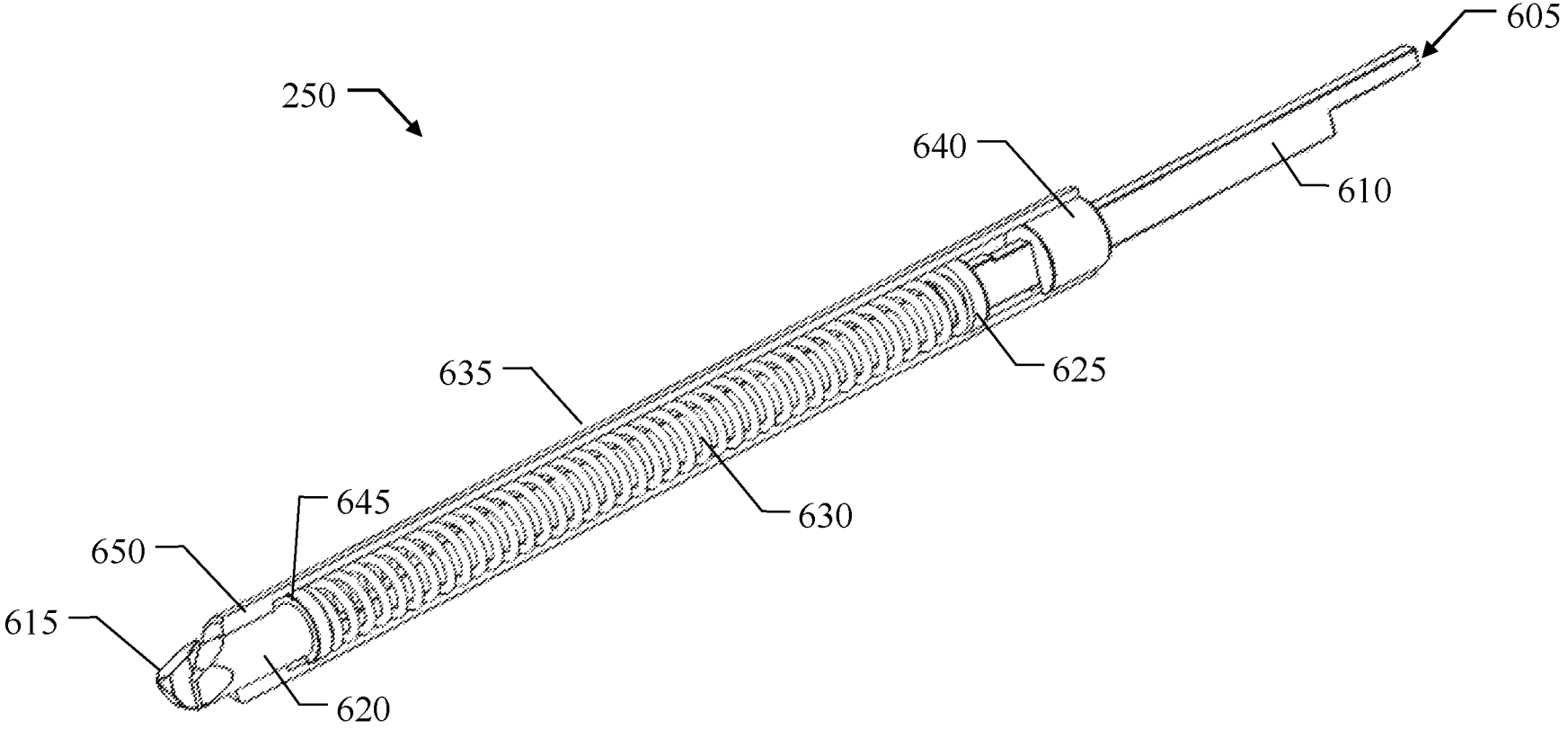

With reference now to FIG. 6A-FIG. 6C, a pictorial representation in cross section is shown of a thread-clamp 250 that may be used to implement the solution according to an embodiment of the present disclosure in different operating conditions. Starting from FIG. 6A, the thread-clamp 250 comprises a crochet 605, which has a stem 610 (for example, with rectangular cross section) terminating at its front end with a hook 615 facing backwards. A body 620, for example, with bush-like shaped, is slidably mounted onto the stem 610. The bush 620 has a (narrower) main portion that widens at a rear end thereof to form an (interference) collar and it has an abutment wall for the hook 615 (i.e., for an inner wall thereof facing it) at a front end thereof; the bush 620 is provided with a through hole matching the stem 610 (for its sliding). A (stop) disk 625 is fixed to the stem 610, at a non-zero distance from a rear end thereof (for example, 20-40% of its length); the disc 625 has the same size and it is coaxial with the collar of the bush 620. A spring 630 (or more) is mounted around the stem 610, between the bush 620 and the disc 625; the spring 630 is preloaded, so s to push the bush 620 and the disk 625 away from each other.

Moreover, the thread-clamp 250 comprises a sleeve 635, which has an inner diameter matching the collar of the bush 620 and the disc 625 and it has a length substantially equal to that of a portion of the crochet 605 from the hook 615 to the disk 625 (slightly higher than it). The sleeve 635 is provided with a (closure) base 640 at a rear end thereof; the base 640 has a through hole matching the stem 610 (with non-circular cross section, so as to prevent its rotation). In addition, the sleeve 635 is provided with a (stop) ring 645 in retracted position with respect to its front end (for example, at a distance therefrom slightly lower than a length of the narrower portion of the bush 620); the ring 645 has an inner diameter matching the narrower portion of the bush 620. In this way, a cavity 650 is defined by a portion of the sleeve 635 behind the ring 640 (outside); a slit (not visible in the figure) is formed along this portion of the sleeve 635, so as to leave the cavity 645 open at the top. An assembly formed by the hook 605, the bush 620 and the spring 630 is slidably mounted into the sleeve 635. Particularly, an inner portion of the assembly comprising the collar of the bush 620, the spring 630 and a corresponding portion of the stem 610 comprising the disc 625 is arranged between the base 640 and the ring 645; in consideration of the above, the distance between the base 640 and the ring 645 is slightly higher than the length of the inner portion of the assembly 605,620,630 with the spring 630 in a rest condition (for example, by 1-2 mm), so that the inner portion of the assembly 605,620,630 is free to slide accordingly along the sleeve 635. At the same time, the stem 610 crosses the base 640 (with a free portion behind the disk 625, at the opposite side of the hook 615, which projects outside the sleeve 635) and the bush 620 crosses the ring 645 (with its narrower portion that projects into the cavity 650).

In a rest condition, as shown in the figure, the spring 630 (preloaded so as to push the bush 620 and the disk 625 away from each other) maintains the hook 615 in contact with the abutment wall of the bush 620. In this condition, the thread-clamp 250 is then closed.

Passing to FIG. 6B, the thread-clamp 250 is opened by moving the hook 605 forwards with respect to the sleeve 635 (for example, by pushing the stem 610 while the sleeve 635 is maintained stationary). As a consequence, the assembly 605,620,630 moves forwards freely along the sleeve 635 until the collar of the bush 620 reaches the ring 645, abutting against it (with the narrower portion of the bush 620 that projects in part outside the sleeve 635); at this point, the hook 605 moves in opposition to the spring 630, which is further compressed between the bush 620 (blocked by the ring 645) and the disc 625. As a result, the hook 615 moves away from the abutment wall of the bush 620 (for example, by 2-4 mm), projecting forwards.

In use, the thread-clamp 250 in the open condition hooks the corresponding thread (not shown in the figure) being tighten transversely to it. Particularly, when the hook 615 (advancing) reaches the thread, the hook 615 lifts the thread above it; as soon as the hook 615 has passed the thread, the hook 615 clears the thread that elastically returns to its previous position resting onto the stem 610 (behind the hook 615). At this point, the thread-clamp 250 is closed by moving the hook 605 backwards with respect to the sleeve 635 (for example, by ceasing the push of the stem 610). As a consequence, the spring 630 pushes the hook 605 backwards (by acting onto the disc 625), until the hook 615 abuts against the abutment wall of the sleeve 620 thereby returning to the closed condition of FIG. 6A.

The above-described thread-clamp 250 allows gripping the thread, thereby blocking it so that it may not slide with respect to the thread-clamp 250, in a simple and effective way.

Particularly, the thread-clamp 250 combines the functions of a crochet (for hooking the thread) with those of a gripper (for blocking the thread).

Passing to FIG. 6C, in the closed condition the hook 605 may also be moved slightly backwards with respect to the sleeve 635 (for example, by pulling the stem 610 while the sleeve 635 is maintained stationary), thanks to the free room that remains between the disc 625 and the base 640. In this way, the thread-clamp 250 is brought into a safety condition, wherein the collar of the bush 620 is spaced away from the ring 645 accordingly. This avoids (or at least substantially reduces) the risk that possible vibrations might cause the opening of the thread-clamp 250 with the loss of the thread. Indeed, at least until the sleeve 620 does not reach the ring 645, these vibrations may at most make the assembly 605,620,630 slide along the sleeve 635, but they may not compress the spring 630 since the bush 620 does not abut against the ring 645.

Figure 7B:
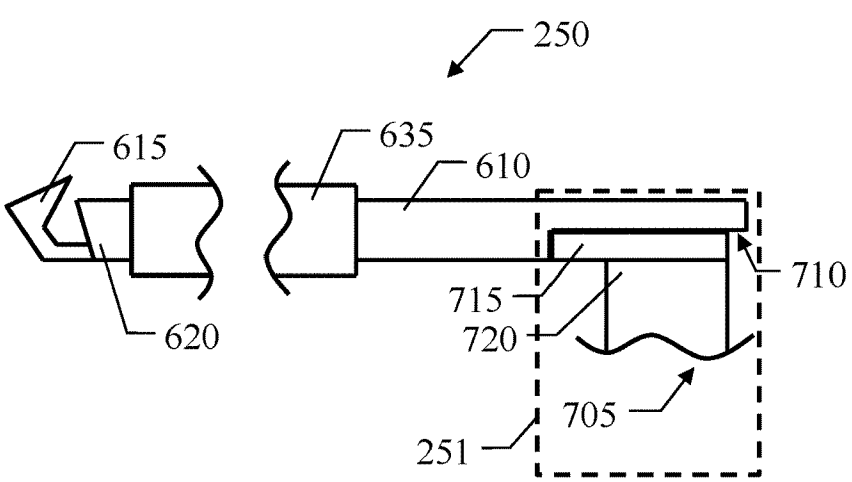
FIG. 7A-FIG. 7B show a schematic representation of a disabling mechanism of the thread-clamp according to an embodiment of the present disclosure in different operating conditions.
Figure 7A:
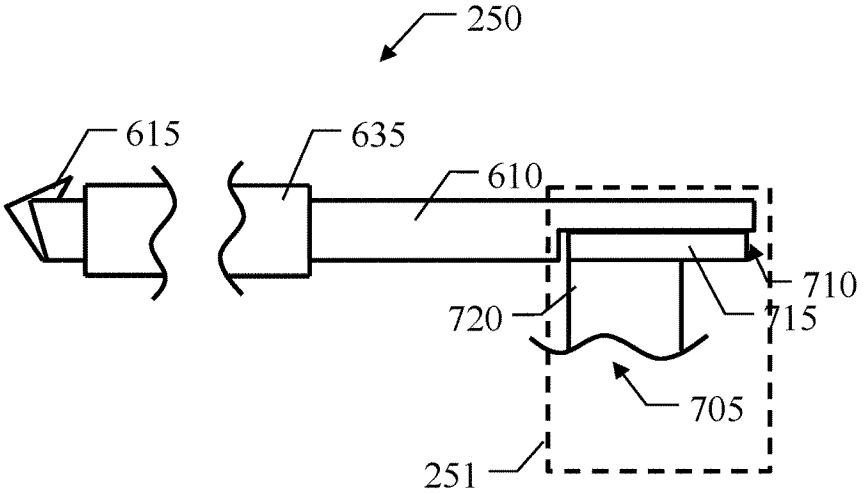

With reference now to FIG. 7A-FIG. 7B, a schematic representation is shown of a disabling mechanism 705 of the thread-clamp 250 according to an embodiment of the present disclosure in different operating conditions.

Starting from FIG. 7A, the stem 610 ends at a free end thereof (opposite the hook 615) with a recess 710 (for example, in lower position). The disabling mechanism 705 of the clamp-thread 250 (part of its drive mechanism comprised in the corresponding support bar, not shown in the figure) comprises a (push) disc 715 arranged in the recess 705; the disc 715 is mounted in an eccentric (offset) way onto a shaft 720. Normally, as shown in the figure, the disc 715 is arranged with a portion thereof projecting from the shaft 720 facing outwards of the recess 710; in this condition, the disc 715 does not interfere with the stem 610 and thus with the functioning of the thread-clamp 250.

Passing to FIG. 7B, the thread-clamp 250 is disabled by rotating the shaft 720 by 180°. In this way, the protruding portion of the disc 715 is now facing inwards of the recess 710; as a consequence, the disc 715 pushes the stem 610 towards the sleeve 635 (held stationary), thereby causing the hook 615 to move away from the abutment wall of the bush 620. In this way, even when the thread-clamp 250 is actuated to be closed (i.e., in the rest condition without pushing the stem 610) it remains open.

Naturally, in order to satisfy local and specific requirements, a person skilled in the art may apply many logical and/or physical modifications and alterations to the present disclosure. More specifically, although this disclosure has been described with a certain degree of particularity with reference to one or more embodiments thereof, it should be understood that various omissions, substitutions and changes in the form and details as well as other embodiments are possible. Particularly, different embodiments of the present disclosure may even be practiced without the specific details (such as the numerical values) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the present disclosure may be incorporated in any other embodiment as a matter of general design choice. In any case, each numerical value should be read as modified by the term about (unless already done) and each range of numerical values should be intended as expressly specifying any possible number along the continuum within the range (comprising its end points). Moreover, ordinal or other qualifiers are merely used as labels to distinguish elements with the same name but do not by themselves connote any priority, precedence or order. The terms include, comprise, have, contain and involve (and any forms thereof) should be intended with an open, non-exhaustive meaning (i.e., not limited to the recited items), the terms based on, dependent on, according to, function of (and any forms thereof) should be intended as a non-exclusive relationship (i.e., with possible further variables involved), the term a/an should be intended as one or more items (unless expressly indicated otherwise), and the term means for (or any means-plus-function formulation) should be intended as any structure adapted or configured for carrying out the relevant function.

For example, an embodiment provides a method for sewing blocks of signatures in a bookbinding sewing machine. However, the signatures may be of any type, for example, overlapped ones and each block may comprise any number of signatures with the possible addition of other elements (for example, inserts); moreover, the sewing machine may be of any type (see below).

In an embodiment, for each block of signatures the method comprises forming one or more stitchings between the signatures of the block by corresponding sewing threads. However, the stitchings may be in any number and formed by sewing threads of any type (for example, synthetic, natural ones).

In an embodiment, each stitching comprises one or more plain stitches and one or more looped stitches concatenated to each other and ends with a free loop on a last one of the signatures of the block. However, the plain stitches and the looped stitches may be formed in any way (for example, only with the normal stitch technique, only with the stagger stitch technique or selectively with each of them).

In an embodiment, for each block of signatures the method comprises bringing each sewing thread (downstream the corresponding plain stitches along a formation direction thereof) to an intermediate position aligned with the corresponding free loop along an advancement direction of the blocks of signatures during the sewing thereof. However, the sewing thread may be brought to any intermediate position (for example, behind or in front of the free loop, at any distance from it along the advancement direction, even zero) in any way (for example, by pulling or pushing it).

In an embodiment, for each block of signatures the method comprises bringing a closing portion of each sewing thread from the intermediate position through the corresponding free loop along the advancement direction (with the closing portion that consists of a portion of the sewing thread downstream the corresponding plain stitches along the formation direction thereof). However, the closing portion may be brought through the free loop in any way (for example, by pulling or pushing it, using the same gripping device or a separate member).

In an embodiment, for each block of signatures the method comprises blocking each sewing thread at a gripping point comprised in the closing portion thereof by actuating a corresponding gripping device. However, the gripping device may be of any type (for example, a thread-clamp, a simple crochet that is rotated to block the sewing thread) and it may be actuated in any way (for example, ceasing the command that maintains the thread-clamp open when normally closed, with a command for closing it when normally open or with two separate commands for closing and for opening it).

In an embodiment, for each block of signatures the method comprises cutting each sewing thread downstream the gripping point thereof along the formation direction of the plain stitches. However, the sewing thread may be cut at any time (see below) and in any way (for example, with a passive-type cutter formed by a simple knife).

In an embodiment, for each block of signatures the method comprises pulling each sewing thread being cut by moving the corresponding gripping device (which blocks the sewing thread being brought through the corresponding free loop) away from the corresponding free loop thereby tightening the free loop around the sewing thread being cut. However, the sewing thread may be pulled in any direction and for any extent (see below), by moving away the gripping device in any way (for example, by further individual mechanisms).

In an embodiment, for each block of signatures the method comprises releasing each sewing thread being pulled by ceasing the actuation of the corresponding gripping device. However, the sewing thread may be released at any time after the free loop has been tightened (as long as it does not interfere with the advancement of the corresponding book block) by ceasing the actuation of the gripping device in any way (see above).

In an embodiment, the stitchings are formed during corresponding operating cycles of the bookbinding sewing machine However, the operating cycles may be defined in any way (for example, starting from the movable saddle being open).

In an embodiment, said step of bringing each sewing thread, said step of bringing a closing portion of each sewing thread, said step of blocking each sewing thread, said step of cutting each sewing thread, said step of pulling each sewing thread and said step of releasing each sewing thread are performed during one or more of the operating cycles. However, these steps may be performed during any number of operating cycles (down to all before starting the sewing of the next block of signatures); in any case, the possibility is not excluded of inserting a short (idle) pause at the end of the sewing of the last signature of the block in specific operating conditions (for example, when the sewing machine works at a very high speed).

In an embodiment, said step of bringing each sewing thread, said step of bringing a closing portion of each sewing thread and said step of blocking each sewing thread are performed in an interval between the operating cycle of formation of the stitchings of the last signature of the block and the operating cycle of formation of the stitchings of a first one of the signatures of a next block. However, these steps may be performed at any other time (for example, only bringing the threads from the needles to the crochets in such interval or completing all the operations before starting the sewing cycle of the first signature of the next block).

In an embodiment, said step of cutting each sewing thread, said step of pulling each sewing thread and said step of releasing each sewing thread are performed after the operating cycle of formation of the stitchings of the first signature of the next block. However, these steps may be performed at any time (for example, during the sewing cycle of the first signature of the next block or after the sewing of any number of signatures of the next block).

In an embodiment, said step of bringing each sewing thread comprises bringing each sewing thread (downstream the corresponding plain stitches along the formation direction thereof) to the intermediate position behind the corresponding free loop along the advancement direction. However, the sewing thread may be brought to the intermediate position at any distance behind the free loop.

In an embodiment, said step of bringing each sewing thread comprises gripping each sewing thread with a corresponding shuttle. However, the shuttle may be of any type (for example, which pulls or pushes the sewing thread).

In an embodiment, said step of bringing each sewing thread comprises moving each shuttle obliquely to the advancement direction. However, the shuttle may be moved obliquely in any way (for example, forming any angle other than 90° with respect to the advancement direction, along a linear or non-linear path); in any case, the same result may be achieved with any other equivalent means (for example, an air blow directed along the same direction).

In an embodiment, said step of bringing a closing portion of each sewing thread comprises inserting the corresponding gripping device through each free loop along the advancement direction thereby hooking the corresponding sewing thread.

However, the gripping device may be brought through the free loop in any way (for example, by individual mechanisms).

In an embodiment, said step of bringing a closing portion of each sewing thread comprises extracting the corresponding gripping device from each free loop along the advancement direction thereby pulling the corresponding sewing thread through the free loop. However, the gripping device may be extracted from the free loop in any way as above.

In an embodiment, said step of blocking each sewing thread comprises actuating each gripping device at the intermediate position. However, the possibility is not excluded of actuating the gripping device at a different position (for example, after bringing the closing portion through the free loop).

In an embodiment, said step of cutting each sewing thread comprises cutting each sewing thread downstream the closing portion thereof along the formation direction of the plain stitches. However, the possibility is not excluded of cutting the sewing thread at another position, as long as it is downstream its gripping point (even in the closing portion itself).

In an embodiment, said step of cutting each sewing thread comprises cutting each sewing thread after said blocking each sewing thread. However, the sewing thread may be cut at any time (for example, at the same time when it is blocked or even slightly before it).

In an embodiment, said step of pulling each sewing thread comprises moving each gripping device to a distance from the corresponding free loop higher than the length of a free portion of the sewing thread being cut downstream its gripping point thereby extracting the free portion of the sewing thread from the free loop. However, the distance to which the sewing thread is pulled may have any value (in terms either absolute or relative); in any case, the possibility is not excluded of pulling the sewing thread to a distance lower than the length of the free portion of the sewing thread so that it is not extracted completely from the free loop.

In an embodiment, said step of pulling each sewing thread comprises moving each gripping device transversally to an advancement direction of the blocks of signatures during the sewing thereof. However, the sewing thread may be pulled in any way transversely to the advancement direction (for example, in vertical) or more generally in any other direction (for example, in parallel to the advancement direction).

In an embodiment, said step of pulling each sewing thread comprises moving each gripping device away from the corresponding plain stitches. However, the possibility is not excluded of pulling the sewing thread in the opposite direction (towards the plain stitches).

In an embodiment, said step of forming one or more stitchings comprises forming the stitchings with a stagger stitch technique wherein in each stitching the plain stitches of a corresponding row are concatenated alternately with the looped stitches of a first row and of a second row adjacent to the row of plain stitches. However, the stagger stitch technique may be implemented in any way (for example, ending the stitchings with the previous crochets).

In an embodiment, the method comprises disabling the gripping device of a last one of the sewing threads that does not form the corresponding free loop. However, this result may be achieved in any way (for example, leaving stationary and/or not actuating the thread-clamps individually).

Generally, similar considerations apply if the same solution is implemented with an equivalent method (by using similar steps with the same functions of more steps or portions thereof, removing some non-essential steps or adding further optional steps); moreover, the steps may be performed in a different order, concurrently or in an interleaved way (at least in part).

An embodiment provides a sewing station for sewing blocks of signatures in a bookbinding sewing machine, wherein the sewing station comprises means configured for performing each of the steps of the above-mentioned method. However, the sewing station may be of any type (for example, with a single loading and sewing saddle). In an embodiment, the gripping device comprises a crochet having a hook for hooking the sewing thread. However, the crochet may be of any type (for example, with a stem having a circular cross-section) with a hook of any type (for example, fishhook-like shaped).

In an embodiment, the gripping device comprises a body having an abutment wall for the hook. However, the body may be of any type, also not bush-like shaped (for example, prismatic-like shaped) with any abutment wall for the hook (for example, narrower, equal or wider than the hook, made in a seat for receiving the hook, at least in part).

In an embodiment, the body and the crochet are slidable reciprocally along a longitudinal direction of the crochet. However, this result may be achieved in any way (for example, even with the hook outside the body).

In an embodiment, the body and the hook are slidable between an open condition wherein the hook is distal from the abutment wall of the body for hooking the sewing thread and a closed condition wherein the hook is proximal to the abutment wall of the body for blocking the sewing thread. However, the sliding required for switching between these conditions may have any extent (with the hook in the closed condition that may be either in contact or slightly separated from the abutment wall according to the thickness of the sewing thread pressed between them).

In an embodiment, the gripping device comprises biasing means for biasing the body and the crochet to the closed condition at rest. However, the biasing means may be implemented in any way (see below); in any case, the possibility is not excluded of biasing the gripping device to the open condition at rest or of avoiding any biasing.

In an embodiment, the crochet is provided with a stop element. However, the stop element may be of any type (for example, one or more teeth).

In an embodiment, the biasing means comprise elastic means acting between the body and the stop element to push the body and the crochet towards the closed condition at rest (with the body and the crochet that are slidable reciprocally towards the open condition in opposition to the elastic means). However, the elastic means may be implemented in any way (for example, with a cylinder of rubber fitted onto the crochet); in any case, the possibility is not excluded of biasing the body and the crochet in a different way (for example, by pulling them along opposite directions).

In an embodiment, the gripping device comprises a further body having a further stop element. However, the further body may be of any type (see below) with any further stop element (for example, one or more teeth).

In an embodiment, the body is blocked in abutment against the further stop element in an operative condition for allowing the passage to the open condition in response to a push of the crochet against the body being blocked by the further stop element. However, the crochet may be pushed against the body in any way (see below); more generally, the passage to the open condition may be obtained in any other way (for example, with a single element that performs the functions of both the body and the further body being integral to each other).

In an embodiment, the further body and an assembly (comprising the crochet, the body and the elastic means) are slidable reciprocally between the operative condition and a safety condition, wherein the further stop element does not interfere with the body for preventing the passage to the open condition. However, the safety condition may be defined by any non-zero distance between the body and the further stop element; in any case, a basic implementation is not excluded wherein the body is always in abutment against the further stop element.

In an embodiment, the further body comprises a sleeve having the further stop element corresponding to a first end thereof and a closure base corresponding to a second end thereof. However, the sleeve may be of any type (for example, with a square cross section); more generally, the further body may be of any other type (for example, a channel).

In an embodiment, the body comprises a main first portion and a second portion having an interference element. However, these portions may have any extents (either in length or in width) and the interference element may be of any type (for example, one or more protrusions).

In an embodiment, an inner portion of the assembly (comprising the second portion of the body, the elastic means and a corresponding portion of the crochet comprising the stop element) is arranged between the further stop element and the closure base. However, the possibility is not excluded of arranging the assembly in any other way (for example, even outside the further body).

In an embodiment, the first portion of the body projects at least partly outside the sleeve through the further stop element in the open condition. However, the first portion of the body may project outside the sleeve for any extent (also zero).

In an embodiment, the closure base has a through hole for the sliding of the crochet. However, this result may be achieved in any way (for example, even without any closure base with a simple stop element for the hook).

In an embodiment, the crochet has a free portion opposite the hook projecting outside the sleeve through the through hole for moving the assembly between the operating condition and the safety condition and for moving the crochet between the open condition and the closed condition. However, this free portion may have any extent; more generally, the same result may be achieved in any other way (for example, acting onto the crochet through a tooth thereof projecting from a longitudinal slit of the sleeve or by acting onto the body with the crochet being blocked).

In an embodiment, a distance between the further stop element and the closure base is higher than a length of the internal portion of the assembly. However, the corresponding difference may have any value (in terms either absolute or relative).

In an embodiment, the further stop element is arranged at a non-zero distance from the first end of the sleeve thereby defining a corresponding cavity for receiving the first portion of the body. However, this distance may have any value (in terms either absolute or relative) to define any cavity (even without any slit); in any case, the possibility is not excluded of arranging the stop element at the corresponding end of the sleeve (without forming any cavity).

In an embodiment, the sewing station comprises means for disabling each gripping device individually. However, the gripping devices may be disabled in any way (for example, being normally enabled and being disabled selectively, or vice-versa, as regards their opening, closing, translation or any combination thereof); in any case, this feature may also be completely omitted (for example, when the thread-clamps may be controlled individually).

In an embodiment, the means for disabling comprise, for each gripping device, means for keeping the hook separated from the abutment wall of the body in the closed condition. However, this result may be achieved in any way (see below).

In an embodiment, the means for disabling comprise, for each gripping device, an eccentric movable between a first position wherein it does not interfere with the crochet and a second position wherein it interferes with the crochet for spacing apart the hook thereof from the abutment wall of the body. However, the eccentric may be of any type (for example, oval-like shaped) and it may space apart the hook from the abutment wall of the body to any distance; more generally, it is possible to act onto the crochet, onto the body or onto both of them with any other element (for example, a piston).

An embodiment provides a gripping device for use in this sewing station.

However, the gripping device may be used for any other purpose (for example, for parking the sewing threads inserted into the needles).

An embodiment provides a bookbinding sewing machine comprising this sewing station. However, the sewing machine may be of any type (for example, capable of folding flat sheets to form the signatures in addition or in alternative to opening signatures already formed).

Generally, similar considerations apply if the sewing station, the gripping device and the sewing machine each has a different structure or comprises equivalent components (for example, of different materials) or it has other operative characteristics. In any case, every component thereof may be separated into more elements, or two or more components may be combined together into a single element;

moreover, each component may be replicated to support the execution of the corresponding operations in parallel. Moreover, unless specified otherwise, any interaction between different components generally does not need to be continuous, and it may be either direct or indirect through one or more intermediaries.

The invention claimed is:

1. A method for sewing blocks of signatures in a bookbinding sewing machine, for each block of signatures the method comprising:

forming one or more stitchings between the signatures of the block by corresponding sewing threads, each stitching comprising one or more plain stitches and one or more looped stitches concatenated to each other and ending with a free loop on a last one of the signatures of the block, bringing each sewing thread, downstream the corresponding plain stitches along a formation direction thereof, obliquely to an advancement direction of the blocks of signatures during the sewing thereof to an intermediate position aligned with the corresponding free loop along the advancement direction, bringing a closing portion of each sewing thread from the intermediate position through the corresponding free loop along the advancement direction, the closing portion consisting of a portion of the sewing thread downstream the corresponding plain stitches along the formation direction thereof, blocking each sewing thread at a gripping point comprised in the closing portion thereof by actuating a corresponding gripping device, cutting each sewing thread downstream the gripping point thereof along the formation direction of the plain stitches, pulling each sewing thread being cut by moving the corresponding gripping device, which blocks the sewing thread being brought through the corresponding free loop, away from the corresponding free loop thereby tightening the free loop around the sewing thread being cut, and releasing each sewing thread being pulled by ceasing the actuation of the corresponding gripping device.

2. The method according to claim 1, wherein the stitchings are formed during corresponding operating cycles of the bookbinding sewing machine, said bringing each sewing thread, said bringing a closing portion of each sewing thread, said blocking each sewing thread, said cutting each sewing thread, said pulling each sewing thread and said releasing each sewing thread being performed during one or more of the operating cycles.

3. The method according to claim 2, wherein said bringing each sewing thread, said bringing a closing portion of each sewing thread and said blocking each sewing thread are performed in an interval between the operating cycle of formation of the stitchings of the last signature of the block and the operating cycle of formation of the stitchings of a first one of the signatures of a next block, and said cutting each sewing thread, said pulling each sewing thread and said releasing each sewing thread are performed after the operating cycle of formation of the stitchings of the first signature of the next block.

4. The method according to claim 1, wherein said bringing each sewing thread comprises:

bringing each sewing thread, downstream the corresponding plain stitches along the formation direction thereof, to the intermediate position behind the corresponding free loop along the advancement direction.

5. The method according to claim 1, wherein said bringing each sewing thread comprises:

gripping each sewing thread with a corresponding shuttle, and moving each shuttle obliquely to the advancement direction.

6. The method according to claim 1, wherein said bringing a closing portion of each sewing thread comprises:

inserting the corresponding gripping device through each free loop along the advancement direction thereby hooking the corresponding sewing thread, and extracting the corresponding gripping device from each free loop along the advancement direction thereby pulling the corresponding sewing thread through the free loop.

7. The method according to claim 1, wherein said blocking each sewing thread comprises:

actuating each gripping device at the intermediate position.

8. The method according to claim 1, wherein said cutting each sewing thread comprises:

cutting each sewing thread downstream the closing portion thereof along the formation direction of the plain stitches.

9. The method according to claim 1, wherein said cutting each sewing thread comprises:

cutting each sewing thread after said blocking each sewing thread.

10. The method according to claim 1, wherein said pulling each sewing thread comprises:

moving each gripping device to a distance from the corresponding free loop higher than the length of a free portion of the sewing thread being cut downstream the gripping point thereof thereby extracting the free portion of the sewing thread from the free loop.

11. The method according to claim 1, wherein said pulling each sewing thread comprises:

moving each gripping device transversally to an advancement direction of the blocks of signatures during the sewing thereof.

12. The method according to claim 1, wherein said pulling each sewing thread comprises:

moving each gripping device away from the corresponding plain stitches.

13. The method according to claim 1, wherein said forming one or more stitchings comprises:

forming the stitchings with a stagger stitch technique wherein in each stitching the plain stitches of a corresponding row are concatenated alternately with the looped stitches of a first row and of a second row adjacent to the row of plain stitches, the method comprising:

disabling the gripping device of a last one of the sewing threads not forming the corresponding free loop.

14. A sewing station for sewing blocks of signatures in a bookbinding sewing machine, wherein the sewing station comprises:

a series of needles and crochets for forming one or more stitchings between the signatures of each of the blocks by corresponding sewing threads, each stitching comprising one or more plain stitches and one or more looped stitches concatenated to each other and ending with a free loop on a last one of the signatures of the block, a series of shuttles each for bringing a corresponding one of the sewing threads, downstream the corresponding plain stitches along a formation direction thereof, obliquely to an advancement direction of the blocks of signatures during the sewing thereof to an intermediate position aligned with the corresponding free loop along the advancement direction, a series of gripping devices each for bringing a closing portion of a corresponding one of the sewing threads from the intermediate position through the corresponding free loop along the advancement direction, the closing portion consisting of a portion of the sewing thread downstream the corresponding plain stitches along the formation direction thereof, a mechanism for actuating the gripping devices each to block the corresponding sewing thread at a gripping point comprised in the closing portion thereof, a series of cutters each for cutting a corresponding one of the sewing threads downstream the gripping point thereof along the formation direction of the plain stitches, the mechanism for moving the gripping devices, each blocking the corresponding sewing thread being brought through the corresponding free loop thereby tightening the free loop around the sewing thread being cut, and the mechanism for ceasing the actuation of the gripping devices each to release the corresponding sewing thread.

15. The sewing station according to claim 14, wherein the gripping device comprises:

a crochet having a hook for hooking the sewing thread, and a body having an abutment wall for the hook, the body and the crochet being slidable reciprocally along a longitudinal direction of the crochet between an open condition wherein the hook is distal from the abutment wall of the body for hooking the sewing thread and a closed condition wherein the hook is proximal to the abutment wall of the body for blocking the sewing thread.

16. The sewing station according to claim 15, wherein the gripping device comprises biasing means for biasing the body and the crochet to the closed condition at rest.

17. The sewing station according to claim 16, wherein the crochet is provided with a stop element, and wherein the biasing means comprise elastic means acting between the body and the stop element to push the body and the crochet towards the closed condition at rest, the body and the crochet being slidable reciprocally towards the open condition in opposition to the elastic means.

18. The sewing station according to claim 17, wherein the gripping device comprises a further body having a further stop element, the body being blocked in abutment against the further stop element in an operative condition for allowing the passage to the open condition in response to a push of the crochet against the body being blocked by the further stop element.

19. The sewing station according to claim 18, wherein the further body and an assembly comprising the crochet, the body and the elastic means are slidable reciprocally between the operative condition and a safety condition wherein the further stop element does not interfere with the body for preventing the passage to the open condition.

20. The sewing station according to claim 19, wherein the further body comprises a sleeve having the further stop element corresponding to a first end thereof and a closure base corresponding to a second end thereof and wherein the body comprises a main first portion and a second portion having an interference element, an inner portion of the assembly comprising the second portion of the body, the elastic means and a corresponding portion of the crochet comprising the stop element being arranged between the further stop element and the closure base, with the first portion of the body projecting at least partly outside the sleeve through the further stop element in the open condition.

21. The sewing station according to claim 20, wherein the closure base has a through hole for the sliding of the crochet, the crochet having a free portion opposite the hook projecting outside the sleeve through the through hole for moving the assembly between the operating condition and the safety condition and for moving the crochet between the open condition and the closed condition.

22. The sewing station according to claim 20, wherein a distance between the further stop element and the closure base is higher than a length of the internal portion of the assembly.

23. The sewing station according to claim 20, wherein the further stop element is arranged at a non-zero distance from the first end of the sleeve thereby defining a corresponding cavity for receiving the first portion of the body.

24. The sewing station according to claim 14, wherein the sewing station comprises means for disabling each gripping device individually.

25. The sewing station according to claim 24, wherein the means for disabling comprise, for each gripping device, means for keeping the hook separated from the abutment wall of the body in the closed condition.

26. The sewing station according to claim 25, wherein the means for disabling comprise, for each gripping device, an eccentric movable between a first position wherein it does not interfere with the crochet and a second position wherein it interferes with the crochet for spacing apart the hook thereof from the abutment wall of the body.

27. A bookbinding sewing machine comprising a sewing station, wherein the sewing station comprises:

a series of needles and crochets for forming one or more stitchings between the signatures of each of the blocks by corresponding sewing threads, each stitching comprising one or more plain stitches and one or more looped stitches concatenated to each other and ending with a free loop on a last one of the signatures of the block, a series of shuttles each for bringing a corresponding one of the sewing threads, downstream the corresponding plain stitches along a formation direction thereof, obliquely to an advancement direction of the blocks of signatures during the sewing thereof to an intermediate position aligned with the corresponding free loop along time advancement direction, a series of gripping devices each of bringing a closing portion of a corresponding one of the sewing threads from the intermediate position through the corresponding free loop along the advancement direction, the closing portion consisting of a portion of the sewing thread downstream the corresponding plain stitches along the formation direction thereof, a mechanism for actuating the gripping devices each to block the corresponding sewing thread at a gripping point comprised in the closing portion thereof, a series of cutters each for cutting a corresponding one of the sewing thread downstream the gripping point thereof along the formation direction of the plain stitches, the mechanism for moving the gripping devices, each of which blocks the corresponding sewing thread being brought through the corresponding free loop, to pull each the thread being cut by away from the corresponding free loop thereby tightening the free loop around the sewing thread being cut, and the mechanism for ceasing the actuation of the gripping devices each to release the corresponding sewing thread.

* * * * *